US009372423B2

(12) United States Patent
Hori et al.

(10) Patent No.: US 9,372,423 B2
(45) Date of Patent: Jun. 21, 2016

(54) IMAGE FORMATION METHOD, TONER SET, AND WHITE TONER

(71) Applicant: Konica Minolta, Inc., Tokyo (JP)

(72) Inventors: Anju Hori, Hachioji (JP); Junya Onishi, Hachioji (JP); Yasuko Uchino, Hino (JP); Ikuko Sakurada, Hachioji (JP); Natsuko Fujisaki, Hino (JP); Junya Ueda, Hino (JP); Takaki Kawamura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/807,266

(22) Filed: Jul. 23, 2015

(65) Prior Publication Data

US 2016/0054669 A1 Feb. 25, 2016

(30) Foreign Application Priority Data

Aug. 25, 2014 (JP) ..... 2014-170708

(51) Int. Cl.

| | |
|---|---|
| ***G03G 9/08*** | (2006.01) |
| ***G03G 13/01*** | (2006.01) |
| ***G03G 15/01*** | (2006.01) |

(52) U.S. Cl.

CPC ..... *G03G 9/0827* (2013.01); *G03G 9/0819* (2013.01); *G03G 13/01* (2013.01); *G03G 13/013* (2013.01); *G03G 13/016* (2013.01); *G03G 15/01* (2013.01); *G03G 15/0168* (2013.01); *G03G 15/0173* (2013.01)

(58) Field of Classification Search

CPC ... G03G 9/0819; G03G 9/0827; G03G 13/01; G03G 13/013; G03G 13/016; G03G 15/01; G03G 15/0168; G03G 15/0173; G03G 2215/01; G03G 2215/017; G03G 2215/0174; G03G 2215/0187

See application file for complete search history.

(56) References Cited

U.S. PATENT DOCUMENTS

2009/0041500 A1* 2/2009 Mitsumori ..... G03G 9/0819 399/159

2009/0296173 A1* 12/2009 Mestha ..... G03G 15/01 358/518

FOREIGN PATENT DOCUMENTS

JP 2007033719 A 2/2007

* cited by examiner

*Primary Examiner* — Joseph S Wong

(74) *Attorney, Agent, or Firm* — Lucas & Mercanti, LLP

(57) ABSTRACT

The invention provides an image formation method, a toner set, and a white toner, by which a masking function of an image layer formed by a white toner on a recording medium can be developed efficiently, and low temperature fixability can be improved. An image formation method for fixing an image forming layer (A) to be formed using a white toner, and an image forming layer (B) to be formed adjacent to the image forming layer (A) using a toner different from the white toner on a recording medium; wherein the following relational expressions (1) and (2) are satisfied:

$$1.000<Dw/Dc<1.300 \quad (1);$$

and $$1.000<Sc/Sw<1.060 \quad (2).$$

9 Claims, No Drawings

IMAGE FORMATION METHOD, TONER SET, AND WHITE TONER

CROSS-REFERENCE TO RELATED APPLICATION

This application is based on Japanese Patent Application No. 2014-170708 filed on Aug. 25, 2014, the contents of which are incorporated herein by reference.

BACKGROUND

1. Technical Field

The present invention relates to an image formation method, a toner set, and a white toner.

2. Description of Related Arts

By an image formation method using an electrophotography system, firstly the surface of an image forming body is charged uniformly by a charging means, then image exposure is conducted to form an electrostatic latent image. The latent image part is developed by a subsequent developing means to form a toner image. In the field of toners for an electrostatic latent image used for image formation in the electrophotography system, developments have been carried out recently in response to various demands from the market. Especially, types of recording media for printing have been increasing, and broad applicability of a printing machine to such recording media is very strongly demanded by the market.

For example, when output is made onto a special recording medium, such as color paper or black paper, aluminum evaporated paper, and transparent film, since color characteristics of a recording medium have an influence, a full-color toner composed solely of 4 colors of yellow, magenta, cyan, and black, cannot sufficiently develop colors. Therefore, it has been proposed to use a white toner newly as the 5th color at the lowermost layer. By forming a white toner image, the hue of a recording medium can be masked, and disorder of an image caused by irregularity of a recording medium surface can be suppressed.

For masking the hue of a recording medium, it is necessary that such a part of a recording medium as corresponds to an image layer part formed by color toners is covered by an image layer formed by a white toner, and further that the toner contains such amount of white pigment as is adequate for masking. However, when the content of a pigment in a toner is increased, the amount of the white pigment exposed to a surface of the toner also increases to deteriorate the electrostatic chargeability, to cause possibly fogging (a phenomenon, in which a trace of toner is transferred to a part where it should not be printed by rights), and to decrease the image intensity in fixing.

To suppress such an image defect, Japanese Patent Application Publication No. 2007-33719 discloses a white toner, in which the contents of a crystalline resin and a white colorant are in specific ranges.

SUMMARY

For achieving reduction of power consumption, higher printing speed, expansion of applicable paper types, etc., a so-called low temperature fixation technology, by which a toner image is fixed at a temperature lower than a heretofore technology, has drawn an attention.

However, if a conventional white toner is used, there remains a drawback that the white toner cannot satisfy sufficiently both the masking performance for a recording medium and the low temperature fixability.

Under such circumstances, objects of the present invention are to provide a image formation method, a toner set, and a white toner, by which a masking function of an image layer formed by a white toner on a recording medium can be developed efficiently, and low temperature fixability can be improved.

For achieving at least one of the objects, an image formation method reflecting an aspect of the present invention includes the following.

[1] An image formation method satisfying the following relational expressions (1) and (2):

$$1.000<Dw/Dc<1.300 \quad (1);$$

and $$1.000<Sc/Sw<1.060 \quad (2);$$

wherein, Dw stands for the volume median diameter of the white toner, Sw for the average circularity of the same, Dc for the volume median diameter of a toner constituting an image forming layer (B) adjacent to an image forming layer (A) to be formed using the white toner, and Sc for the average circularity of the same.

[2] The image formation method according to [1] above, wherein the image forming layer (A) and the image forming layer (B) are fixed collectively to form an image.

[3] The image formation method according to [1] or [2] above, wherein the toner different from the white toner is a color toner.

[4] The image formation method according to any one of [1] to [3] above, satisfying 1.010<Sc/Sw<1.040.

[5] The image formation method according to any one of [1] to [4] above, satisfying 0.910<Sw<0.943.

[6] The image formation method according to any one of [1] to [5] above, wherein the white toner and the toner different from the white toner include a crystalline polyester resin.

[7] The image formation method according to any one of [1] to [6] above, satisfying 1.050<Dw/Dc<1.250.

DETAILED DESCRIPTION

A first aspect of the present invention is an image formation method for fixing an image forming layer (A) to be formed using a white toner, and an image forming layer (B) to be formed adjacent to the image forming layer (A) using a toner different from the white toner on a recording medium; wherein, expressing the volume median diameter of the white toner as Dw, the average circularity of the same as Sw, the volume median diameter of the toner different from the white toner as Dc, and the average circularity of the same as Sc, the following relational expressions (1) and (2) are satisfied:

$$1.000<Dw/Dc<1.300 \quad (1);$$

and $$1.000<Sc/Sw<1.060 \quad (2).$$

A second aspect of the present invention is a toner set including a white toner and a toner different from the white toner to be used for an image forming layer (B) adjacent to an image forming layer (A) to be formed using the white toner; wherein, expressing the volume median diameter of the white toner as Dw, the average circularity of the same as Sw, the volume median diameter of the toner different from the white toner as Dc, and the average circularity of the same as Sc, the above relational expressions (1) and (2) are satisfied.

In the second aspect, the toner different from the white toner is preferably a color toner. In the second aspect, 1.010<Sc/Sw<1.040 is preferable. In the second aspect, 0.910<Sw<0.943 is preferable. In the second aspect, the white toner and the toner different from the white toner contain preferably a crystalline polyester resin. In the second aspect, 1.050<Dw/Dc<1.250 is preferable.

A toner set means herein a combination of toners, which form different image forming layers, when transferred on to a recording medium. Therefore, if, for example, a combination of a white toner and a black toner for forming a gray image, wherein the black toner and the white toner are packed in a common bottle, does not fall within the scope of a toner set.

A third aspect of the present invention is a white toner satisfying the above expressions (1) and (2) with respect to a relationship with a toner different from the white toner to be used for an image forming layer (B) adjacent to an image forming layer (A) to be formed using the white toner; wherein, Dw stands for the volume median diameter of the white toner, Sw for the average circularity of the same, Dc for the volume median diameter of the toner different from the white toner, and Sc for the average circularity of the same. In the third aspect, the toner different from the white toner is preferably a color toner. In the third aspect, 1.010<Sc/Sw<1.040 is preferable. In the third aspect, 0.910<Sw<0.943 is preferable. In the third aspect, the white toner and the toner different from the white toner contain preferably a crystalline polyester resin. In the third aspect, 1.050<Dw/Dc<1.250 is preferable.

A toner different from the white toner is hereinafter also referred to as "Other Toner". When there are 2 or more kinds of not-white toners in an image formation device, ordinarily any of the toners can be a toner constituting an image forming layer (B). Therefore, when there are 2 or more kinds of not-white toners in an image formation device, it is preferable that all of the toners should satisfy the relational expressions (1) and (2). Further, it is preferable, the same should satisfy a favorable range with respect to the relational expressions (1) and (2), and favorable conditions with respect to an Other Toner described below.

An image forming layer means herein a toner image, which is formed by transferring a toner on to a recording medium, and not yet fixed to the recording medium.

In view of an aimed effect of the present invention, namely improvement of masking performance on a recording medium by an image forming layer formed by a white toner, the order of layers is preferably: a recording medium, an image forming layer (A) formed by a white toner, and an image forming layer (B) formed by an Other Toner. In this regard, during fixation by a fixing roller, the image forming layer (B) is positioned on the fixing roller side.

In the case of Dw/Dc≤1.000, the masking performance on a recording medium by a white color image is remarkably suppressed. An Other Toner, which is supposed to be closer to a fixing roller compared to a white toner, the Other Toner melts earlier during fixation. In the case of Dw/Dc≤1.000, the particle size of an Other Toner is the same as that of a white toner, or large r than that of a white toner, and there fore it is presumed that the melted Other Toner during fixation melts to cover the white toner, and thereby the Other Toner can easily mix with the white toner, and as the result the masking performance on a recording medium by a white color image is remarkably suppressed. In the case of Dw/Dc≥1.300 low temperature fixability is remarkably reduced. It is presumed that the particle size of a white toner is large in a range of Dw/Dc≥1.300 so as to increase the irregularity of the interface between an image forming layer (A) and an image forming layer (B), and as the result there occurs unevenness in fixability leading to lower image intensity. Further, in the case of Dw/Dc≥1.300, the saturation or density of an image formed by an Other Toner decreases also. This is presumably because a surface of an image forming layer (A) becomes rougher due to the increase in the particle size of a white toner, and it becomes difficult for an Other Toner to be packed dense, and as the result the saturation and density of an image are lowered.

Meanwhile, in the case of Sc/Sw<1.000, the masking performance on a recording medium by a white color image is remarkably suppressed. This is presumably because the bonding strength is decreased due to lower circularity of an Other Toner compared to the circularity of a white toner. Further, in the case of Sc/Sw≥1.060 low temperature fixability is remarkably reduced, and the masking performance on a recording medium by a white color image is remarkably suppressed. It is presumed that, in the case of Sc/Sw≥1.060, voids increase between an image forming layer (A) formed by a white toner and an image forming layer (B) formed by an Other Toner to cause a drawback in the image intensity, and further that a white toner and an Other Toner are not packed together to generate large irregularity on an image layer, and therefore the masking performance on a recording medium by a white color image is remarkably suppressed.

The volume median diameter is a median diameter according to volume (volume-based median diameter) measured with a high precision particle size distribution analyzer using a Coulter principle (for example, Multisizer 3, produced by Beckman Coulter, Inc.). Specifically, the following methods in Example are used as a measuring method and a calculate method for a volume median diameter and a circularity.

In other words, in the first to the third aspects, it is characterized that a white toner and a toner forming a toner image adjacent to a white toner image satisfy the relationships of $$1.000<Dw/Dc<1.300 \quad (1),$$

and $$1.000<Sc/Sw<1.060 \quad (2).$$

When a white toner and an Other Toner satisfying the relationships of (1) and (2) are used, a high quality image, in which the masking performance on a recording medium by a white color is excellent, and the bonding performance between a white toner and a neighboring toner is improved while maintaining fixability, can be outputted. Namely, with the image formation method of the first aspect, the toner set of the second aspect, and the white toner of the third aspect, the masking performance on a recording medium by an image layer formed by a white color can be expressed more efficiently, and the low temperature fixability can be improved. When the relationships (1) and (2) are satisfied, it is believed that a white toner and an Other Toner are arranged and layered evenly, and by such arrangement and layering the masking performance on a recording medium by a white color can be secured, and a function of an Other Toner, for example, if an Other Toner is a color toner, the saturation of a color toner can be secured.

Since the low temperature fixability and the masking performance by a white color are improved further, 1.050<Dw/Dc<1.250 is preferable, and 1.050<Dw/Dc<1.200 is more preferable. Further, 1.010<Sc/Sw<1.040 is preferable, and 1.020<Sc/Sw<1.040 is more preferable. If 1.010<Sc/Sw, and preferably 1.020<Sc/Sw, the masking performance by a white color image is improved further. If Sc/Sw<1.040, voids between toners can be reduced while securing the arrangement and layering, which is preferable in view of the masking performance or the fixability.

The volume median diameter Dw of a white toner may be selected appropriately corresponding to the volume median diameter Dc of an Other Toner so as to satisfy the expression (1), and is preferably from 4.8 to 13.2 μm from viewpoints of fixability, and electrical stability, and more preferably from 5.8 to 8.3 μm. In this regard, the electrical stability means toner powder properties related to transferability, cleaning property, and developing property, etc.

Further, the average circularity Sw of a white toner may be selected appropriately corresponding to the average circularity Sc of an Other Toner so as to satisfy the expression (2), and Sw is preferably more than 0.910 from a viewpoint of electrical stability, more preferably $0.910<Sw<0.943$, and further preferably from 0.917 to 0.932.

There is no particular restriction on an Other Toner, insofar as it is other than a white toner. Examples of the same include a color toner, a transparent toner (constituted with at least a binder resin, and not containing a colorant, but allowing, if necessary, an additive such as a mold releasing agent, and an external additive to be contained), a metallic color (containing at least a binder resin and a metallic pigment, and allowing, if necessary, an additive such as a mold releasing agent, and an external additive to be contained), a color extinction toner, and an infrared- and near-infrared light absorbing toner.

The volume median diameter Dc of an Other Toner may be selected appropriately corresponding to the volume median diameter Dw of a white toner so as to satisfy the expression (1), and is preferably from 4.8 to 11.8 μm from a viewpoint of low temperature fixability, and more preferably from 4.8 to 8.0 μm.

Further, the average circularity Sc of an Other Toner may be selected appropriately corresponding to the average circularity Sw of a white toner so as to satisfy the expression (2), and Sc is preferably from 0.910 to 0.960 from a viewpoint of electrical stability, and more preferably from 0.925 to 0.955.

It is preferable that an Other Toner is a color toner, because an effect that the masking performance by a white toner expresses efficiently can be exhibited more remarkably.

A white toner is constituted with at least a binder resin and a white colorant. It may further contain, if necessary, another additive such as a mold releasing agent, or an external additive.

A color toner is constituted with at least a binder resin, and a colorant having a color other than white. It may further contain, if necessary, another additive such as a mold releasing agent, or an external additive. In this regard, "having a color" means to have a color other than white (for example, yellow, magenta, cyan, and black).

(Colorant)

AS a colorant, carbon black, a magnetic material, a dye, a pigment, etc. can be used optionally; and as carbon black, channel black, furnace black, acetylene black, thermal black, lamp black, etc. can be used. As a magnetic material, a ferromagnetic metal, such as iron, nickel, and cobalt; an alloy containing such metals; a ferromagnetic metal compound, such as ferrite, and magnetite; an alloy not containing a ferromagnetic metal but exhibiting ferromagnetism after a heat treatment; a type of alloy called as a Heusler alloy, such as manganese-copper-aluminum, and manganese-copper-tin; chromium dioxide; etc. can be used.

Specific examples of a white colorant include inorganic pigments, such as heavy calcium carbonate, light calcium carbonate, titanium oxide, aluminum hydroxide, titanium white, talc, calcium sulfate, barium sulfate, zinc oxide, magnesium oxide, magnesium carbonate, amorphous silica, colloidal silica, white carbon, kaolin, fired kaolin, delaminated kaolin, aluminosilicate, sericite, bentonite, and smectite; and organic pigments, such as a polystyrene resin particle, and a urea-formalin resin particle. A white colorant may include a pigment having a hollow structure, such as a hollow resin particle, and hollow silica. From viewpoints of electrostatic chargeability and masking performance, a white colorant is preferably titanium oxide. Titanium oxide with any crystal structure, such as anatase-type, rutile-type, and brookite-type, can be used.

As a black colorant, for example, carbon black, such as furnace black, channel black, acetylene black, thermal black, and lamp black, and further a magnetic powder, such as magnetite, and ferrite, may be used.

Examples of a colorant for magenta or red include C. I. Pigment red 2, C. I. Pigment red 3, C. I. Pigment red 5, C. I. Pigment red 6, C. I. Pigment red 7, C. I. Pigment red 15, C. I. Pigment red 16, C. I. Pigment red 48: 1, C. I. Pigment red 53: 1, C. I. Pigment red 57: 1, C. I. Pigment red 122, C. I. Pigment red 123, C. I. Pigment red 139, C. I. Pigment red 144, C. I. Pigment red 149, C. I. Pigment red 150, C. I. Pigment red 166, C. I. Pigment red 177, C. I. Pigment red 178, C. I. Pigment red 184, C. I. and Pigment red 222.

Examples of a colorant for orange or yellow include C. I. Pigment orange 31, C. I. Pigment orange 43, C. I. Pigment yellow 12, C. I. Pigment yellow 13, C. I. Pigment yellow 14, C. I. Pigment yellow 15, C. I. Pigment yellow 17, C. I. Pigment yellow 74, C. I. Pigment yellow 93, C. I. Pigment yellow 94, C. I. Pigment yellow 138, C. I. Pigment yellow 155, C. I. Pigment yellow 180, and C. I. Pigment yellow 185.

Examples of a colorant for green or cyan include C. I. Pigment blue 15, C. I. Pigment blue 15: 2, C. I. Pigment blue 15: 3, C. I. Pigment blue 15: 4, C. I. Pigment blue 16, C. I. Pigment blue 60, C. I. Pigment blue 62, C. I. Pigment blue 66, and C. I. Pigment green 7.

The colorants may be used singly or in a combination of 2 or more selected therefrom according to need.

The addition amount of a colorant is preferably in a range of from 1 to 60 weight-% with respect to the total of a toner, and more preferably from 2 to 25 weight-%. In such a range, the color reproducibility of an image can be secured.

The size of a colorant is in terms of volume mean diameter preferably from 10 to 1000 nm, more preferably from 50 to 500 nm, and especially preferably from 80 to 300 nm.

Since an Other Toner is a toner for constituting an image forming layer (B) adjacent to an image forming layer (A), for example, in the case of an image formation method (device) using yellow, magenta, cyan, black colors in addition to a white color, any of the toners can be a toner for constituting an image forming layer (B). Therefore, in such a method (device), it is preferable that all toners of yellow, magenta, cyan, and black should satisfy the expressions (1) and (2).

(Binder Resin)

As a binder resin, conventional resins used for toners can be used, and examples thereof include a polyester resin; a polymer of styrene and a substitution product thereof, such as poly(vinyl toluene); a styrene-based copolymer, such as a styrene-p-chlorostyrene copolymer, a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl-α-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, and a styrene-maleate copolymer; poly(methyl methacrylate); poly(butyl methacrylate); poly(vinyl chloride); poly(vinyl acetate); polyethylene; polypropylene; an epoxy resin; an epoxy polyol resin; polyurethane; polyamide; poly(vinyl butyral); a polyacrylic resin; a rosin; a modified rosin; a terpene resin; an aliphatic or alicyclic hydrocarbon resin; and an aromatic petroleum resin.

From a viewpoint of low temperature fixability with respect to fixation of a toner image at a low temperature, as a binder resin use of at least a crystalline polyester resin is preferable. In this regard, at least either of a white toner and an Other Toner should preferably contain a crystalline polyester resin, and more preferably both of a white toner and an Other Toner contain a crystalline polyester resin. Further, from viewpoints of low temperature fixability and heat-resistant storage stability of a toner, it is preferable to use as a binder resin a combination of a crystalline polyester resin and an amorphous resin, and more preferable to use a combination of a crystalline polyester resin and an amorphous polyester resin.

<Crystalline Polyester Resin>

A crystalline polyester resin means a resin having a clear endothermic peak instead of a stepwise endothermic change by a differential scanning calorimetric analysis (DSC) among publicly known polyester resins to be obtained by a polycondensation reaction of a di- or higher valent carboxylic acid (polycarboxylic acid) and a di- or higher valent alcohol (polyhydric alcohol). A clear endothermic peak means specifically a peak, which is an endothermic peak with a half band width of 15° C. or less by a differential scanning calorimetric analysis (DSC) measured with a temperature increase rate of 10° C./min as described in Example.

There is no particular restriction on a crystalline polyester resin, insofar as this is as defined above. For example, a resin having a structure where in a backbone of a crystalline polyester resin another component is copolymerized is also included in a crystalline polyester resin according to the present invention, insofar as the resin exhibits a clear endothermic peak as described above.

The weight-average molecular weight (Mw) of a crystalline polyester resin is preferably from 2,000 to 20,000. In the range, an obtainable toner particle does not have a low melting point as a whole particle, and is superior in anti-blocking property, and also superior in low temperature fixability.

The melting point (Tm) of a crystalline polyester resin is preferably 50° C. or more and less than 120° C., and more preferably 60° C. or more and less than 90° C. It is preferable that the melting point of a crystalline polyester resin is within the range, because the low temperature fixability and releasability during fixation can be attained appropriately. An endothermic peak temperature measured by the method described in Example is defined as the melting point of a crystalline polyester resin.

The acid value (AV) of a crystalline polyester resin is preferably from 5 to 70 mg-KOH/g.

A crystalline polyester resin is formed from a polycarboxylic acid component and a polyhydric alcohol component. The respective valences of a polycarboxylic acid component and a polyhydric alcohol component are preferably from 2 to 3, and especially preferably 2. Therefore, as an especially preferable mode, a case with respective valences of 2 (namely a dicarboxylic acid component and a diol component) will be described.

As a dicarboxylic acid component, use of an aliphatic dicarboxylic acid is preferable, and an aromatic dicarboxylic acid may be used together. As an aliphatic dicarboxylic acid, use of a straight chain type is preferable. When a straight chain type is used, the crystallinity is improved advantageously. A dicarboxylic acid component is not restricted to a single kind, and 2 or more kinds may by used in a combination. As an aliphatic dicarboxylic acid, use of a straight chain type aliphatic dicarboxylic acid, in which the number of carbon atoms constituting the backbone is from 2 to 22, is more preferable.

Examples of an aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,10-dodecanedicarboxylic acid (1,10-dodecanedioic acid), 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; and a lower alkyl ester thereof and an anhydride thereof may be also used.

Among the aliphatic dicarboxylic acids, from a viewpoint of availability, a straight chain type aliphatic dicarboxylic acid having 6 to 14 carbon atoms is preferable, and adipic acid, 1,8-octanedicarboxylic acid, 1,9-nonanedicarboxylic acid, 1,10-decanedicarboxylic acid, and 1,10-dodecanedicarboxylic acid (1,10-dodecanedioic acid) are more preferable.

Examples of an aromatic dicarboxylic acid include terephthalic acid, isophthalic acid, ortho-phthalic acid, t-butylisophthalic acid, 2,6-naphthalenedicarboxylic acid, and 4,4'-biphenyldicarboxylic acid. Among them, from viewpoints of availability and emulsifiability, use of terephthalic acid, isophthalic acid, and t-butylisophthalic acid is preferable.

The amount of an aliphatic dicarboxylic acid to be used is preferably 80 mol-% or more with respect to the total amount of a dicarboxylic acid component for forming a crystalline polyester resin as 100 mol-%, more preferably 90 mol-% or more, and further preferably 100 mol-%. When the amount of an aliphatic dicarboxylic acid to be used is 80 mol-% or more, the crystallinity of a crystalline polyester resin can be secured, so that a toner to be produced can be superior in low temperature fixability, an image to be finally formed can acquire high gloss, deterioration of image storage stability due to melting point depression can be suppressed, and further an emulsified state can be securely attained when oil droplets are formed using an oil-phase liquid containing the crystalline polyester resin.

As a diol component, it is preferable to use an aliphatic diol, and if necessary a diol other than an aliphatic diol may be contained. As a diol component, among aliphatic diols, use of a straight chain type aliphatic diol, in which the number of carbon atoms constituting the backbone is from 2 to 22, is more preferable.

Examples of an aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol, 1,13-tridecanediol, 1,14-tetradecanediol, 1,18-octadecanediol, and 1,20-eicosanediol. Among them, from viewpoints of availability and secure expression of low temperature fixability, those with the number of carbon atoms constituting the backbone of from 2 to 14 are preferable.

A branched aliphatic diol can be used as a diol component, and in this case it is preferable from a viewpoint of securing crystallinity to use the same together with a straight chain type aliphatic diol, and use the straight chain type aliphatic diol at a higher percentage. By using a straight chain type aliphatic diol at a higher percentage, the crystallinity can be secured, so that a toner to be produced can secure a superior low temperature fixability, deterioration of image storage stability due to melting point depression can be suppressed with respect to an image to be finally formed, and an anti-blocking property can be acquired securely.

Diol components may be used singly or in a combination of 2 or more kinds.

As a diol component for forming a crystalline polyester resin, the content of an aliphatic diol is preferably 80 mol-% or more with respect to the total amount of a diol component for forming a crystalline polyester resin as 100 mol-%, more preferably 90 mol-% or more, and further preferably 100 mol-%. When the content of an aliphatic diol in a diol component is 80 mol-% or more, the crystallinity of a crystalline polyester resin can be secured, so that a toner to be produced can secure a superior low temperature fixability, and an image to be finally formed can acquire high gloss.

Examples of a diol other than an aliphatic diol include a diol having a double bond and a diol having a sulfonic acid group. Specific examples of a diol having a double bond include 2-butene-1,4-diol. The content of a diol having a double bond in a diol component is preferably 20 mol-% or less.

If necessary, in order to adjust an acid value or a hydroxy value, a monovalent acid, such as acetic acid, and benzoic acid; a monovalent alcohol, such as cyclohexanol, and benzyl alcohol; benzenetricarboxylic acid and naphthalenetricarboxylic acid as well as an anhydride thereof and a lower alkyl ester thereof; a trivalent and a quadrivalent alcohol, such as glycerine, trimethylolethane, trimethylolpropane, and pentaerythritol, may be used together.

A crystalline polyester resin can be synthesized from an optional combination of those selected from the afore-described constituents using a heretofore publicly known method, wherein a transesterification method, a direct polycondensation method, etc. may be used singly or in a combination thereof.

Specifically, the synthesis may be performed at a polymerization temperature from 140° C. to 270° C., and the reaction is carried out with removing water or an alcohol generated by condensation, if necessary, under reduced pressure in a reaction system. When monomers are not soluble or miscible each other at a reaction temperature, a high boiling point solvent may be added as a compatibilizing solvent for dissolution. A polycondensation reaction is carried out while distilling off the compatibilizing solvent. In a copolymerization reaction, if there exists a monomer with poor compatibility, it is preferable that the monomer with poor compatibility and an acid or an alcohol, with which the monomer is intended to undergo polycondensation, are condensed in advance, and then subjected to polycondensation with a main component.

With respect to the ratio of the diol component to the dicarboxylic acid component to be used, the equivalent ratio [OH]/[COOH] of hydroxy groups [OH] in a diol component and carboxy groups [COOH] in a dicarboxylic acid component is preferably from 1.5/1 to 1/1.5, and further preferably from 1.2/1 to 1/1.2. When the ratio of the diol component to the dicarboxylic acid component to be used is in the range, a crystalline polyester resin with a desired molecular weight can be securely obtained.

Examples of a catalyst usable for producing a crystalline polyester resin are titanium-containing catalysts including titanium aliphatic carboxylates, e.g. a titanium aliphatic monocarboxylate, such as titanium acetate, titanium propionate, titanium hexanoate, and titanium octanoate; a titanium aliphatic dicarboxylate, such as titanium oxalate, titanium succinate, titanium maleate, titanium adipate, and titanium sebacate; a titanium aliphatic tricarboxylate, such as titanium hexanetricarboxylate, and titanium isooctanetricarboxylate; and a titanium aliphatic polycarboxylate, such as titanium octanetetracarboxylate and titanium decanetetracarboxylate; titanium aromatic carboxylates, e.g. a titanium aromatic monocarboxylate, such as titanium benzoate; a titanium aromatic dicarboxylate, such as titanium phthalate, titanium terephthalate, titanium isophthalate, titanium naphthalenedicarboxylate, titanium biphenyldicarboxylate, and titanium anthracenedicarboxylate; a titanium aromatic tricarboxylate, such as titanium trimellitate, and titanium naphthalenetricarboxylate; a titanium aromatic tetracarboxylate, such as titanium benzenetetracarboxylate, and titanium naphthalenetetracarboxylate; titanyl compounds of the titanium aliphatic carboxylates or the titanium aromatic carboxylates, and alkali metal salts thereof; halogenated titanium compounds, such as dichlorotitanium, trichlorotitanium, tetrachlorotitanium, and tetrabromotitanium; tetraalkoxy titanium compounds, such as tetrabutoxy titanium (titanium tetrabutoxide), tetraoctoxy titanium, and tetrastearoxy titanium; titanium acetylacetonate; titanium diisopropoxide bis acetyl acetonate; and titanium triethanol aminate.

The content of a crystalline polyester resin with respect to 100 parts by weight of the whole toner is ordinarily from 1 to 40 parts by weight, and preferably from 5 to 20 parts by weight. When the addition amount of a crystalline polyester resin is 40 parts by weight or less, occurrence of embedment or filming of an external additive can be suppressed. Meanwhile, when the content is 1 part by weight or more, an improvement effect on low temperature fixability can be obtained effectively.

<Amorphous Resin>

Although there is no particular restriction on an amorphous resin, an amorphous polyester resin produced by condensation of a polyhydric alcohol component and a polycarboxylic acid component is preferable.

An amorphous polyester resin is a polyester resin other than the crystalline polyester resin. In other words, an amorphous polyester resin ordinarily does not have a melting point, and has a relatively high glass transition temperature (Tg). More specifically, the glass transition temperature (Tg) is preferably between 40 and 90° C., and especially preferably between 45 and 80° C. In this regard, a glass transition temperature (Tg) is measured by the method described in Example.

The weight-average molecular weight (Mw) of an amorphous resin is preferably from 3,000 to 100,000, and more preferably from 4,000 to 70,000. When the weight-average molecular weight (Mw) of an amorphous resin is within the range, a toner to be obtained is superior in an anti-blocking property and is able to acquire a favorable low temperature fixability.

Although there is no particular restriction on the polyhydric alcohol component, examples thereof include aliphatic diols, such as ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol, 1,13-tridecanediol, 1,14-tetradecanediol, 1,18-octadecanediol, and 1,20-eicosanediol; bisphenols, such as bisphenol A, and bisphenol F; and alkylene oxide adducts of a bisphenol, such as an ethylene oxide adduct, and a propylene oxide adduct of the above-listed bisphenol; as well as trivalent or higher polyhydric alcohol components, such as glycerine, trimethylolpropane, pentaerythritol, and sorbitol. Further, in view of production cost, or environmental characteristics, cyclohexanedimethanol, cyclohexanediol, neopentyl alcohol, etc. may be used. Further as a polyhydric alcohol component able to form an amorphous polyester resin, for example, an unsaturated polyhydric alcohol, such as 2-butyne-1,4-diol, 3-butyne-1,4-diol, and 9-octadecene-7,12-diol, may be used.

Among them, from viewpoints of electrostatic chargeability and toner strength, an ethylene oxide adduct of bisphenol A and/or a propylene oxide adduct of bisphenol A is preferable as a polyhydric alcohol component.

The polyhydric alcohol components may be used singly, or in combination of 2 or more kinds thereof.

Examples of a divalent carboxylic acid component to be condensed with any of the above polyhydric alcohol components include aromatic carboxylic acids, such as terephthalic acid, isophthalic acid, phthalic anhydride, trimellitic anhydride, pyromellitic acid, and naphthalenedicarboxylic acid; aliphatic carboxylic acids, such as maleic anhydride, fumaric acid, succinic acid, alkenyl succinic acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; alicyclic carboxylic acids, such as cyclohexanedicarboxylic acid; and a lower alkyl ester and an acid anhydride of the listed acids. The acids may be used singly, or in combination of 2 or more kinds thereof.

When especially alkenyl succinic acid or the anhydride thereof among the polycarboxylic acids is used, due to presence of an alkenyl group, which hydrophobicity is higher than other functional groups, this acid can be easily miscible with a crystalline polyester resin. Examples of an alkenyl succinic acid component include n-dodecyl succinic acid, n-dodecenyl succinic acid, isododecyl succinic acid, isododecenyl succinic acid, n-octyl succinic acid, and n-octenyl succinic acid, as well as an acid anhydride, an acid chloride, and a lower alkyl ester having 1 to 3 carbon atoms of the above.

When a tri- or higher valent carboxylic acid is added, a polymer chain can include a cross-linked structure, and owing to inclusion of the cross-linked structure decrease in the elastic modulus in a high temperature region can be suppressed, and therefore the offset resistance in a high temperature region can be improved.

Examples of the tri- or higher valent carboxylic acid include trimellitic acids, such as 1,2,4-benzenetricarboxylic acid, and 1,2,5-benzenetricarboxylic acid; 1,2,4-naphthalenetricarboxylic acid, hemimellitic acid, trimesic acid, mellophanic acid, prehnitic acid, pyromellitic acid, mellitic acid, and 1,2,3,4-butanetetracarboxylic acid as well as an acid anhydride, an acid chloride, and a lower alkyl ester having 1 to 3 carbon atoms of the above. Trimellitic acid (anhydride) is especially preferable. The acids may be used singly, or in combination of 2 or more kinds thereof.

The softening temperature of an amorphous polyester resin is preferably between 70 and 140° C., and more preferably between 70 and 125° C. The acid value of an amorphous polyester resin is preferably from 5 to 70 mg-KOH/g.

Examples of an amorphous resin further include, in addition to an amorphous polyester resin, a styrene-acrylic resin described in Japanese Patent Application Publication No. 2011-197659.

An amorphous resin can be produced by a similar method as for the crystalline polyester resin.

The content of an amorphous resin is ordinarily from 50 to 95 parts by weight with respect to 100 parts by weight of the whole toner, and preferably from 50 to 80 parts by weight. Within the range, a toner to be obtained can be superior in an anti-blocking property and is able to acquire a favorable low temperature fixability.

A white toner and an Other Toner may contain, if necessary, an internal additive, such as a mold releasing agent, and a charge control agent, and an external additive, such as an inorganic fine particle, an organic fine particle, and a lubricant.

(Mold Releasing Agent (Wax))

There is no particular restriction on a mold releasing agent constituting a toner, and publicly known ones may be used. Specific examples of the same include low molecular weight polyolefins, such as polyethylene, polypropylene, and polybutene; plant waxes, such as a synthetic ester wax, carnauba wax, rice bran wax, candellila wax, Japan wax, and jojoba oil; mineral and petroleum waxes, such as montan wax, paraffin wax, microcrystalline wax, and Fischer-Tropsch wax; and modified products thereof. The mold releasing agents may be used singly, or in combination of 2 or more kinds thereof.

The addition amount of a mold releasing agent is ordinarily from 0.5 to 25 parts by weight with respect to 100 parts by weight of the whole toner, and preferably from 3 to 20 parts by weight. Within the range, it has an effect on prevention of hot offset, and securance of releasability.

In a case where a toner is produced by an emulsion aggregation method, the size of a mold releasing agent in terms of volume mean diameter is preferably from 10 to 1000 nm, more preferably from 50 to 500 nm, and further preferably from 80 to 300 nm.

(Charge Control Agent)

As a charge control agent, various publicly known compounds may be used. Examples of a charge control agent include for positive charge a nigrosine type electron-donating dye, a metal salt of naphthenic acid or a higher fatty acid, an alkoxylated amine, a quaternary ammonium salt, an alkylamide, a metal complex, a pigment, and a fluorinated activator; and for negative charge an electron-receiving organic complex, a chlorinated paraffin, a chlorinated polyester, and sulfonyl amine of copper phthalocyanine.

The addition amount of a charge control agent is, with respect to 100 parts by weight of a binder resin in a toner particle to be obtained finally, ordinarily from 0.1 to 10 parts by weight, and preferably from 0.5 to 5 parts by weight.

(External Additive)

Onto a surface of a toner particle, a publicly known particle, such as an inorganic and organic fine particle, and lubricant may be added as an external additive, for purpose of improving an electrostatic property and flowability as a toner, or a cleaning property.

Examples of a favorable inorganic fine particle include silica, titania, alumina, and strontium titanate.

If necessary, the inorganic fine particles may be subjected to a hydrophobization treatment.

For the organic fine particle, a spherical organic fine particle with a number average primary particle diameter in an approximate range of 10 to 2000 nm may be used. Specifically, an organic fine particle of a homopolymer of, or a copolymer between, styrene, methyl methacrylate, or the like, may be used.

A lubricant is used for purpose of improving further a cleaning property or transferability, and examples of a lubricant include metal salts of a higher fatty acid, such as stearic acid salts of zinc, aluminum, copper, magnesium, and calcium; oleic acid salts of zinc, manganese, iron, copper, and magnesium; palmitic acid salts of zinc, copper, magnesium, and calcium; linoleic acid salts of zinc, and calcium; and ricinolic acid salts of zinc, and calcium. Various combinations of the external additives may be also used.

The addition amount of an external additive is preferably from 0.1 to 10.0 weight-% with respect to the whole toner particle.

Examples of an addition method of an external additive include addition methods using any of various publicly known mixing apparatus, such as a Turbula Mixer, a Henschel mixer, a Nauta Mixer, and a V-shaped mixer.

(Production Method of Toner)

There is no particular restriction on a method for producing a toner, and examples thereof include publicly known methods, such as a kneading-grinding method, a suspension polymerization method, an emulsion aggregation method, a dissolution suspension method, a polyester elongation method, and a dispersion polymerization method.

Among them, use of an emulsion aggregation method or a kneading-grinding method is preferable. Meanwhile, a white toner and an Other Toner may employ different production methods, and one of which may be produced by an emulsion aggregation method, and the other by a kneading-grinding method. For example, an Other Toner may be produced by an emulsion aggregation method, and a white toner by a kneading-grinding method.

<Kneading-Grinding Method>

A kneading-grinding method is a method by which at least a binder resin and a colorant are mixed, subjected to a kneading treatment, and followed by a grinding treatment to yield a toner. Further, if necessary, after the grinding treatment, a classification treatment is conducted using, for example, a publicly known classification apparatus, etc. Furthermore, before a kneading treatment, a binder resin, a colorant, and, if necessary, an additive, such as a mold releasing agent, and charge control agent, may be admixed adequately by a mixing machine, such as a Henschel mixer and a ball mill.

(1) Kneading Treatment Step

There is no particular restriction on a kneader used for a kneading treatment, and a general kneader, such as a twin-screw extruding kneader, a triple roll mill, and a Labo Plastomill, may be used.

During a kneading treatment, an internal additive may be added. For kneading, it is preferable to perform heating, and there is no particular restriction on a heating condition, which may be set appropriately.

After a heated kneading treatment, the kneaded mixture is sent to the next step, namely a grinding step, ordinarily after cooling. In this regard, the cooling rate after the end of the kneading treatment step may be decided appropriately.

(2) Grinding Treatment Step

There is no particular restriction on a mill used for a grinding treatment, and, for example, a mechanical mill such as a TurboMill, and an airflow mill (jet mill) may be used. Further, the kneaded mixture may be subjected to a coarse crushing treatment by a hammer mill, a Feather Mill, or the like before a grinding treatment, so that the kneaded mixture solidified into chips by cooling in a kneading treatment is crushed to a size feedable into a mill.

A toner particle yielded in a grinding step may be, if necessary, classified in a classification step, so as to yield a toner particle with a volume median diameter in an intended range. In a classification step, a gravity classifier, a centrifugation classifier, an inertial classifier (such as a classifier applying Coanda effect), etc. which have been heretofore used, may be used, so as to reject a fine powder (toner particle with a particle size smaller than an intended range), and a coarse powder (toner particle with a particle size larger than an intended range).

A particle obtained after the grinding treatment, or the classification treatment, as the case may be, (hereinafter also referred to as a "base material particle") has preferably a volume median diameter of from 4.8 to 13.2 μm. Further, a coefficient of variation (CV value) of the volume-based particle size distribution of a base material particle is preferably from 10 to 32. A coefficient of variation (CV value) of a volume-based particle size distribution represents a dispersion of the particle size distribution of a toner particle on a volume-basis, and defined by the following equation.

$$CV\text{ value }(\%)=(\text{standard deviation of number-based particle size distribution})/(\text{median diameter of number-based particle size distribution }(D50n))\times 100$$

When a toner is produced by a kneading-grinding method, the volume median diameter of a toner can be regulated by grinding conditions (rotating speed of a mill, grinding time), classification conditions, treatment conditions of the following circularity regulating step, and treatment conditions of an external additive addition step described below (rotating speed of a mixing machine, mixing time).

(3) Circularity Regulating Step (Rounding Treatment Step)

When a toner is produced by a kneading-grinding method, it should preferably include a circularity regulating step, in which the average circularity of a toner is regulated so as to satisfy the formula (2). In this case, at least an Other Toner among an Other Toner and a white toner should preferably be subjected to a circularity regulating step, and more preferably both the Other Toner and the white toner are subjected to a circularity regulating step. In other words, according to a preferable Embodiment, an Other Toner (favorably, an Other Toner and a white toner) undergoes a kneading treatment for mixing at least a binder resin and a colorant, then the yielded mixture is subjected to a grinding treatment for grinding the mixture, and thereafter to a circularity regulating treatment thereby yielding a toner.

Specifically, examples of a circularity regulating treatment include a heat treatment on a base material particle. The circularity can be regulated by a heating temperature and a retention time. By regulating the heating temperature higher, or the retention time longer, the circularity can be made closer to 1. However, an excessively high heating temperature may promote recoagulation of toner particles, or fusion among particles, which is unfavorable. Similarly, an excessively long retention time may change the domain structure inside a toner (arrangement of a wax, a crystalline polyester, etc. other than a binder, with respect to the binder resin as a matrix), which is also unfavorable.

The heating temperature in a circularity regulating treatment may be adjusted appropriately so that Sc/Sw satisfies the formula (2), and it is preferably from 70 to 95° C., and more preferably from 75 to 90° C. When an amorphous polyester resin is used, a circularity regulating treatment is carried out ordinarily at a temperature in the vicinity of a range between Tg and the softening point of the amorphous polyester resin. However, since the optimum point is influenced by other constituting materials (amounts of a wax, or a colorant), the heating temperature may be set appropriately considering such other materials. Further, the retention time at a heating temperature may be adjusted appropriately considering the heating temperature so that Sc/Sw satisfies the formula (2). The circularity can be regulated by measuring during heating the circularity of a particle having a volume median diameter of 2 μm or more by a circularity measuring apparatus to judge appropriately whether a desired circularity is being obtained.

A circularity regulating treatment may be performed by either of dry heating and wet heating. Wet heating is a method, by which a heat treatment is performed with base material particles dispersed in an aqueous medium. In this case, in order to improve the dispersion stability of base material particles, a surfactant, etc. may be added. Examples of the surfactant include anionic surfactants, such as an alkyl benzene sulfonate, an α-olefin sulfonate, and a phosphoric ester; cationic surfactants of an amine salt type, such as an alkyl amine salt, an amino alcohol fatty acid derivative, a polyamine fatty acid derivative, and imidazoline; and cationic surfactants of a quaternary ammonium salt type, such as an alkyltrimethylammonium salt, a dialkyldimethylammonium salt, an alkyldimethylbenzylammonium salt, a pyridinium salt, an alkylisoquinolinium salt, and benzethonium chloride; nonionic surfactants, such as a fatty acid amide derivative, and a polyhydric alcohol derivative; and amphoteric surfactants, such as alanine, dodecyl-di(aminoethyl)glycine, di(octylaminoethyl)glycine, and a N-alkyl-N,N-dimethylammonium betaine. Further, an anionic surfactant and a cationic surfactant, having a fluoroalkyl group may be also used.

A production method of a toner particle by a kneading-grinding method may include after the circularity regulating treatment step the following (4) filtration and washing step, (5) drying step, and (6) external additive addition step.

(4) Filtration and Washing Step

In this filtration and washing step, a filtration treatment, by which a dispersion liquid of the obtained toner particles is cooled to prepare a cooled slurry, the toner particles are separated by solid-liquid separation from the cooled dispersion liquid of toner particles using a solvent such as water, and the toner particles are filtrated, and a washing treatment, by which attached substances such as a surfactant are removed from the filtrated toner particles (cake-like aggregate), are conducted. Specific examples of methods for solid-liquid separation and washing include a centrifugation method, a suction filtration method using an aspirator, a suction funnel, etc., and a filtration method using a filter press, etc., but are not particularly limited thereto. In the filtration and washing step, pH adjustment, crushing, or the like may be conducted appropriately. Such operations may be repeated.

(5) Drying Step

In this drying step the toner particles after the washing treatment is subjected to a drying treatment. Examples of a dryer to be used in the drying step include an oven, a spray dryer, a vacuum freeze dryer, a vacuum dryer, a stationary tray dryer, a moving tray dryer, a fluidized bed dryer, a rotary dryer, and an agitation dryer, without particular limitation thereto. The moisture content in a toner particle after the drying treatment measured by a Karl-Fischer coulometric titration method is preferably 5 weight-% or less, and more preferably 2 weight-% or less.

If toner particles having received the drying treatment have coagulated to form an aggregate due to weak interparticle attraction, the aggregate may be subjected to a disintegrating treatment. In this case, as a disintegrating treatment apparatus, a mechanical disintegrating apparatus, such as a jet mill, a COMIL, a Henschel mixer, a coffee mill, and a food processor, may be used.

(6) External Additive Addition Step

In this external additive addition step, external additives, such as a charge control agent, various inorganic and organic fine particles, and a lubricant, are added for purpose of improvement of flowability, electrification characteristic, and cleaning property, to the toner particles having received a drying treatment. This step is performed according to need. Examples of an apparatus used for adding an external additive include various publicly known mixing apparatus, such as a Turbula Mixer, a Henschel mixer, a Nauta Mixer, a V-shaped mixer, and a sample mill. Further, sieve classification may be conducted according to need for adjusting the particle size distribution of a toner in an appropriate range.

<Emulsion Aggregation Method>

An emulsion aggregation method is a method for forming toner particles, by which a dispersion liquid of resin fine particles of a resin (hereinafter also referred to as "resin fine particles") dispersed with a surfactant or a dispersion stabilizer is mixed with a dispersion liquid of a component constituting a toner particle, such as fine particles of a colorant, a coagulant is added to cause coagulation allowing to grow to a desired particle size of a toner, and the resin fine particles are fused together after or at the same time as the coagulation to regulate the shape.

In this regard, a resin fine particle may be a composite particle, which is formed with a plurality of layers, namely constituted with 2 or more layers composed of different resin compositions.

Resin fine particles may be produced for example by an emulsion polymerization method, a mini-emulsion polymerization method, or a phase inversion emulsification method; or by a combination of some of the above methods. When an internal additive is added to a resin fine particle, among others, use of a mini emulsion polymerization method is preferable.

When an internal additive is added into a toner particle, a resin fine particle containing an internal additive may be used, or a dispersion liquid of internal additive fine particles composed solely of the internal additive may be prepared separately, and the internal additive fine particles may be coagulated together when resin fine particles are coagulated.

By an emulsion aggregation method, a toner particle having a core-shell structure can be also obtained. Specifically, a toner particle having a core-shell structure can be obtained: firstly by coagulating (fusing) fine particles of a binder resin for a core particle and fine particles of a colorant to produce core particles; and then by adding fine particles of a binder resin for a shell layer into a dispersion liquid of the core particles, and by coagulating and fusing the fine particles of a binder resin for shell layer on a surface of the core particles to form a shell layer covering the surface of the core particles.

When a toner is produced by an emulsion aggregation method, a production method of a toner according to a preferable Embodiment includes a step (1) for preparing a dispersion liquid of crystalline polyester resin fine particles, a dispersion liquid of amorphous resin fine particles, and a colorant dispersion liquid (hereinafter also referred to as "preparation step"), and a step (2) for mixing, coagulating and fusing the dispersion liquid of crystalline polyester resin fine particles, the dispersion liquid of amorphous resin fine particles, and the colorant dispersion liquid (hereinafter also referred to as "coagulating and fusing step").

The respective steps will be described below in detail.

(1) Preparation Step

More precisely a step (1) includes a preparation step for a dispersion liquid of binder resin fine particles, and a preparation step for a colorant dispersion liquid, if necessary as well as a preparation step for a dispersion liquid of a mold releasing agent. With respect to an Embodiment, in which a crystalline polyester resin and an amorphous resin are used as binder resins, a preparation step for a dispersion liquid of polyester resin fine particles, and a preparation step for a dispersion liquid of amorphous resin fine particles will be described below.

(1-1) Preparation Step for Dispersion Liquid of Crystalline Polyester Resin Fine Particles/Preparation Step for Dispersion Liquid of Amorphous Resin Fine Particles A preparation step for a dispersion liquid of crystalline polyester resin fine particles is a step for synthesizing a crystalline polyester resin to constitute toner particles, and dispersing the crystalline polyester resin in an aqueous medium as fine particles to prepare a dispersion liquid of crystalline polyester resin fine particles. Meanwhile, a preparation step for a dispersion liquid of amorphous resin fine particles is a step for synthesizing an amorphous resin to constitute toner particles, and dispersing the amorphous resin in an aqueous medium as fine particles to prepare a dispersion liquid of amorphous resin fine particles.

Examples of a method for dispersing a crystalline polyester resin or an amorphous resin in an aqueous medium include a method, by which the crystalline polyester resin or an amorphous resin is dissolved or dispersed in an organic solvent (solvent) to prepare an oil-phase liquid, the oil-phase liquid is dispersed in an aqueous medium by phase inversion emulsification or the like to form oil droplets in a regulated state exhibiting a desired particle size, and the organic solvent is removed.

As an organic solvent (solvent) used for preparing an oil-phase liquid, a solvent with a low boiling point and low solubility in water is preferable from a viewpoint of easiness in removing the same after formation of oil droplets. Specific examples thereof include methyl acetate, ethyl acetate, methyl ethyl ketone, isopropyl alcohol, methyl isobutyl ketone, toluene, and xylene. These may be used singly, or in combination of 2 or more kinds.

The amount of an organic solvent (solvent) to be used (when 2 or more kinds are used, the total amount) with respect to 100 parts by weight of a resin is ordinarily from 1 to 300 parts by weight, preferably from 10 to 200 parts by weight, and further preferably from 25 to 100 parts by weight.

Further, ammonia, sodium hydroxide, etc. may be added into an oil-phase liquid to ionize a carboxy group so as to stabilize emulsification in a water phase for facilitating smooth emulsification.

The amount of an aqueous medium to be used with respect to 100 parts by weight of an oil-phase liquid is preferably from 50 to 2,000 parts by weight, and more preferably 100 to 1,000 parts by weight. When the amount of an aqueous medium to be used is in the range, an oil-phase liquid can be emulsified in the aqueous medium in a desired particle size.

In an aqueous medium, a dispersion stabilizer may be dissolved, and also a surfactant, resin fine particles, or the like may be added for purpose of improving the dispersion stability of oil droplets.

Examples of a dispersion stabilizer include inorganic compounds, such as tricalcium phosphate, calcium carbonate, titanium oxide, colloidal silica, and hydroxyapatite. However, since it is necessary to remove a dispersion stabilizer from the obtained toner base material particle, use of those soluble in an acid or an alkali, such as tricalcium phosphate, is preferable, and from an environmental viewpoint, use of those degradable by an enzyme is preferable.

As a surfactant, those similar to the surfactants to be used for dispersing the base material particles by the kneading-grinding method can be used.

As resin fine particles for improving dispersion stability, those with a particle size of from 0.5 to 3 μm is preferable. Specific examples thereof include poly(methyl methacrylate) resin fine particles with a particle size of from 1 μm to 3 μm, polystyrene resin fine particles with a particle size of from 0.5 μm to 2 μm, and poly(styrene-co-acrylonitrile) resin fine particles with a particle size of 1 μm.

Such an oil-phase liquid may be dispersed and emulsified utilizing mechanical energy. There is no particular restriction on a disperser for emulsification, and examples thereof include a low speed shearing disperser, a high speed shearing disperser, a frictional disperser, a high pressure jet disperser, an ultrasonic disperser such as an ultrasonic homogenizer, and a high pressure impact disperser Ultimaizer.

Removal of an organic solvent after formation of oil droplets may be carried out for example by the following procedures: the temperature of an entire dispersion liquid in a state that crystalline polyester resin fine particles and amorphous resin fine particles are dispersed in an aqueous medium is increased gradually with stirring; the liquid is agitated vigorously in a specific temperature range; and then the solvent is removed. Alternatively, the solvent may be removed using an apparatus such as an evaporator while reducing pressure.

In the thus prepared dispersion liquid of crystalline polyester resin fine particles or dispersion liquid of amorphous resin fine particles, the particle size of crystalline polyester resin fine particles (oil droplets) or amorphous resin fine particles (oil droplets) is in terms of volume mean diameter preferably from 60 to 1000 nm, and more preferably from 80 to 500 nm. In this regard, a volume mean diameter is measured by the method described in Example. Further, the volume mean diameter of oil droplets can be regulated by the magnitude of mechanical energy during emulsification.

In the dispersion liquid of crystalline polyester resin fine particles or dispersion liquid of amorphous resin fine particles, the content of crystalline polyester resin fine particles or amorphous resin fine particles with respect to 100 weight-% of the dispersion liquid is preferably from 10 to 50 weight-%, and more preferably from 15 to 40 weight-%.

Within the range, broadening of the particle size distribution can be suppressed so as to improve toner characteristics.

(1-2) Step for Preparation of Dispersion Liquid of Colorant Fine Particles

The step for preparation of a dispersion liquid of colorant fine particles is an essential step in the case of a white toner, and is also performed, when a color toner is desired as a toner particle. In the step, a dispersion liquid of colorant fine particles is prepared by dispersing a colorant in an aqueous medium as fine particles.

The aqueous medium is as described above, and to which a surfactant, resin fine particles, or the like may be added for purpose of improving the dispersion stability.

Dispersion of a colorant may be performed by utilizing mechanical energy. There is no particular restriction on such a disperser, and examples thereof include as described above a low speed shearing disperser, a high speed shearing disperser, a frictional disperser, a high pressure jet disperser, an ultrasonic disperser such as an ultrasonic homogenizer, and a high pressure impact disperser Ultimaizer.

The volume mean diameter of colorant fine particles is preferably from 10 to 300 nm, and more preferably from 100 to 200 nm.

The content of colorant fine particles in a dispersion liquid of colorant fine particles is preferably in a range from 10 to 50 weight-%, and more preferably in a range from 15 to 40 weight-%. Within the range, it is effective for securing color reproducibility.

(1-3) Step for Preparation of Dispersion Liquid of Mold Releasing Agent Fine Particles The step for preparation of a dispersion liquid of mold releasing agent fine particles is a step to be performed optionally when a toner particle containing a mold releasing agent is desired. In the step, a dispersion liquid of mold releasing agent fine particles is prepared by dispersing a mold releasing agent in an aqueous medium as fine particles.

The aqueous medium is as described above, and to which a surfactant, resin fine particles, or the like may be added for purpose of improving the dispersion stability.

Dispersion of a mold releasing agent may be performed by utilizing mechanical energy. There is no particular restriction on such a disperser, and examples thereof include as described above a low speed shearing disperser, a high speed shearing disperser, a frictional disperser, a high pressure jet disperser, an ultrasonic disperser such as an ultrasonic homogenizer, a high pressure impact disperser Ultimaizer, and a high pressure homogenizer.

If necessary, for dispersing a mold releasing agent, heating may performed.

The volume mean diameter of mold releasing agent fine particles is preferably from 10 to 300 nm.

The content of mold releasing agent fine particles in a dispersion liquid of mold releasing agent fine particles is preferably in a range from 10 to 50 weight-%, and more preferably in arrange from 15 to 40 weight-%. Within the range, it is effective for preventing hot offset and securing releasability.

(2) Coagulating and Fusing Step

In the coagulating and fusing step, a dispersion liquid of crystalline polyester resin fine particles, a dispersion liquid of amorphous resin fine particles, and a dispersion liquid of colorant fine particles, as well as, if necessary, other components such as a dispersion liquid of mold releasing agent fine particles are added, mixed, and allowed to coagulate slowly by balancing a repulsive force of a fine particle surface due to pH adjustment and a cohesive force due to addition of a coagulant composed of an electrolytic body so that association between particles is carried out under regulation of the average particle diameter, and particle size distribution, and at the same time the mixture liquid is heated with stirring to fuse together the fine particles to regulate the shape, thereby forming toner particles. The coagulating and fusing step can be performed by utilizing mechanical energy or a heating means according to need.

In the coagulating step, the respective dispersion liquids thus obtained are mixed to a mixture liquid, which is then heated at a temperature below the glass transition temperature of the amorphous resin to coagulate and form agglomerated particles. The formation of agglomerated particle is conducted by changing the pH of the mixture liquid to acidic while stirring. The pH is preferably in a range from 2 to 7, more preferably in a range from 2.2 to 6, and further preferably in a range from 2.4 to 5. In this case, it is also effective to use a coagulant.

As a coagulant for this purpose, a surfactant with the polarity opposite to that of a surfactant used for a dispersing agent, and an inorganic metal salt, as well as a di- or higher valent metal complex can be used favorably.

Examples of an inorganic metal salt include metal salts, such as calcium chloride, calcium nitrate, barium chloride, magnesium chloride, zinc chloride, aluminum chloride, and aluminum sulfate, and inorganic metal salt polymers, such as poly aluminum chloride, poly aluminum hydroxide, and calcium polysulfide. Among them, aluminum salt and a polymer thereof are especially favorable. For obtaining a narrower particle size distribution, with respect to the valence of an inorganic metal salt, divalent is more favorable than monovalent, trivalent is more favorable than divalent, and tetravalent is more favorable than trivalent.

By adding supplementally amorphous resin fine particles when agglomerated particles have grown to a desired particle size, a toner (core-shell particle) having a constitution, in which a surface of a core agglomerated particle is covered by an amorphous resin, can be produced. In the case that a supplemental addition is made, a coagulant may be added or the pH may be adjusted before the supplemental addition.

On the occasion of coagulation, heating for raising a temperature is preferably performed. In this case, if the temperature attains or exceeds a fusion temperature by heating, the fusing step proceeds at the same time. The temperature increase rate is preferably in a range from 0.01 to 5° C./min. The heating temperature (peak temperature) is preferably in a range from 40 to 100° C.

When agglomerated particles have grown to a desired particle size, coagulation of various fine particles in a reaction system is terminated (hereinafter also referred to as "coagulation termination step"). The termination of coagulation can be performed by adding a coagulation terminating agent composed of a basic compound, which can regulate a pH to a direction going out of the pH milieu where a coagulation action on fine particles in the coagulation step is promoted, so that the coagulation action on fine particles in a reaction system is suppressed. There is no particular restriction on a desired particle size of agglomerated particles, and a volume median diameter is preferably approx. from 4.5 to 7.0 μm.

In the coagulation termination step, the pH of a reaction system is preferably regulated between 5.0 and 9.0.

Examples of a coagulation terminating agent (basic compound) include ethylenediaminetetraacetic acid (EDTA) and an alkali metal salt, such as a sodium salt, thereof, Gluconal, sodium gluconate, potassium citrate and sodium citrate, nitrotriacetate (NTA) salt, GLDA (commercially-supplied L-glutamic acid-N,N-diacetic acid), humic acid and fulvic acid, maltol and ethylmaltol, pentaacetic acid and tetraacetic acid, a publicly known water-soluble polymer having both functional groups of a carboxy group and a hydroxy group (polyelectrolyte), sodium hydroxide, and potassium hydroxide. In the coagulation termination step stirring may be conducted the same as in the coagulation step.

The fusing step is a step for forming fused particles by heating a reaction system after the coagulation termination step or concurrently with the coagulation step to a predetermined fusion temperature so that respective fine particles constituting an agglomerated particle are fused together to forma fused particle.

The fusion temperature in the fusing step is preferably not less than the melting point of a crystalline polyester resin, and the fusion temperature is preferably higher than the melting point of a crystalline polyester resin by from 0 to 20° C. There is no particular restriction on the heating duration, insofar as fusion is possible, and it may be from 0.5 to 10 hours.

In the coagulating and fusing step, a surfactant may be added in an aqueous medium so as to disperse stably respective fine particles in a coagulation system.

As a surfactant, a similar surfactant to be used for dispersing base material particles by the kneading-grinding method can be used.

The addition amount ratio (weight ratio) of amorphous resin fine particles/crystalline polyester resin fine particles in the coagulating and fusing step is preferably from 1 to 100. Within the range, a toner to be obtained is superior in high temperature storage ability as well as in low temperature fixability.

In a case where another internal additive is introduced in a toner particle, a method by which a dispersion liquid of internal additive fine particles containing only an internal additive is prepared prior to the coagulating and fusing step, and the dispersion liquid of internal additive fine particles is mixed with a dispersion liquid of crystalline polyester resin fine particles, a dispersion liquid of amorphous polyester resin fine particles, and a colorant dispersion liquid in the coagulating and fusing step, is preferable.

After fusion, a dispersion liquid is cooled down to yield fused particles. The cooling rate may be selected appropriately.

When a toner is produced by the emulsion aggregation method, the volume median diameter of a toner can be regulated by a regulation of particle size growth of an agglomerated particle (coagulation condition), and a regulation of rounding conditions.

When a toner is produced by the emulsion aggregation method, the circularity regulating step is preferably performed after the coagulating and fusing step, so that the circularity of a toner is regulated to satisfy the formula (2). In this case, a circularity regulating treatment is preferably carried out at least on an Other Toner among an Other Toner and a white toner, and more preferably a circularity regulating treatment is carried out on both the Other Toner and the white toner. In other words, according to a preferable Embodiment, in a production method of an Other Toner (favorably, an Other Toner and a white toner), there are a step for preparing a dispersion liquid of binder resin fine particles (preferably, a dispersion liquid of crystalline polyester resin fine particles, and a dispersion liquid of amorphous resin fine particles), and a colorant dispersion liquid (hereinafter also referred to as "preparation step") (1), a step for mixing, coagulating, and fusing the dispersion liquid of binder resin fine particles, and the colorant dispersion liquid (hereinafter also referred to as "coagulating and fusing step") (2), and a circularity regulating step (3) for regulating the circularity of a toner.

As a specific circularity regulating treatment, there is for example a heat treatment for heating particles obtained in the coagulating and fusing step. The circularity can be regulated by a heating temperature and a retention time. By raising the heating temperature higher, or extending the retention time longer, the circularity can be made closer to 1. However, an excessively high heating temperature may promote recoagulation of toner particles, or fusion among particles, which is unfavorable. Similarly, an excessively long retention time may change the domain structure inside a toner (arrangement of a wax, a crystalline polyester, etc. other than a binder, with respect to the binder resin as a matrix), which is also unfavorable.

The heating temperature in a circularity regulating treatment may be adjusted appropriately so that Sc/Sw satisfies the formula (2), and it is preferably from 70 to 95° C., and more preferably from 75 to 90° C. Alternatively, when an amorphous polyester resin is used, a circularity regulating treatment is carried out ordinarily at a temperature in the vicinity of a range between Tg and the softening point of the amorphous polyester resin. However, since the optimum point is influenced by other constituting materials (amounts of a wax, or a colorant), the heating temperature may be set appropriately considering such other materials. Further, the retention time at a heating temperature may be adjusted appropriately so that Sc/Sw satisfies the formula (2). The circularity can be regulated by measuring during heating the circularity of a particle having a volume median diameter of 2 μm or more by a circularity measuring apparatus to judge appropriately whether a desired circularity is being obtained.

Further, a production method of a toner by the emulsion aggregation method may include (4) a filtration and washing step, (5) a drying step, and (6) an external additive addition step. The filtration and washing step, the drying step, and the external additive addition step are the same as described above in the section of the kneading-grinding method.

(Developer)

As conceivable applications of the toner, there are, for example, a case in which a toner containing a magnetic material is used as a 1-component magnetic toner, a case in which a toner is mixed with a so-called carrier, and used as a 2-component developer, and a case in which a nonmagnetic toner is used singly; and the toner can be used favorably in any case.

As a carrier constituting a 2-component developer, a magnetic particle composed of a heretofore known material, such as a metal (e.g. iron, ferrite, and magnetite), and an alloy with the above metal and another metal (e.g. aluminum, and lead) can be used, and especially use of a ferrite particle is preferable.

The volume mean diameter of a carrier is preferably from 15 to 100 μm, and more preferably from 25 to 80 μm.

As a carrier, use of a carrier coated with a resin, or a so-called resin-dispersed carrier, in which magnetic particles are dispersed in a resin, is preferable. There is no particular restriction on a resin composition for coating, and for example, an olefinic resin, a copolymer of cyclohexyl methacrylate and methyl methacrylate, a styrenic resin, a styrene-acrylic resin, a silicone resin, an ester-based resin, or a fluorine-containing polymer resin are used. As a resin for constituting a resin-dispersed carrier, there is no particular restriction, and a publicly known resin may be used, for example, an acrylic resin, a styrene-acrylic resin, a polyester resin, a fluorine-containing resin, and a phenolic resin may be used.

(Image Formation Method)

In an image formation method of the first aspect, an image is formed by fixing an image forming layer (A) to be formed using a white toner, and an image forming layer (B) to be formed adjacent to the image forming layer (A) using a toner different from the white toner, on a recording medium. In this case, there are a method, by which an image forming layer (A) obtained by transferring a white toner on a recording medium is first fixed, and then an image forming layer (B) obtained by transferring an Other Toner on a recording medium is fixed, and a method, by which an image forming layer (A) obtained by transferring a white toner on a recording medium and an image forming layer (B) obtained by transferring an Other Toner on a recording medium are fixed collectively. However, since an effect of the present invention can be obtained more effectively, and image formation is faster, the image forming layer (A) and the image forming layer (B) should preferably be fixed collectively to form an image.

Appropriately, an electrostatic latent image formed electrostatically on an image carrier is developed to an actual image by electrifying a developer with a frictional electrification member in a developing device and yielding a toner image (image forming layer). The toner image is transferred on to a recording medium, and then the toner image transferred on a recording medium is fixed to the recording material by a fixation treatment based on a direct contact heating system, thereby yielding a visible image.

As a favorable fixation method, a so-called direct contact heating system can be named as an example.

Examples of a direct contact heating system include especially a hot pressing fixation system, and further a heat roll fixation system, and a pressurized heating fixation system using a revolving pressurizing member provided inside with a fixed heater.

In a fixation method with a heat roll fixation system, a fixation device ordinarily constituted with an upper roller provided with a heat source inside a metal cylinder made of iron or aluminum, whose surface is coated with a fluorocarbon resin, etc., and a lower roller formed of silicone rubber, etc. is used As a heat source a linear heater is used, by which an upper roller is heated to a surface temperature of approx. 120 to 200°

C. A pressure is applied between an upper roller and a lower roller, and the lower roller is deformed by the pressure to form a so-called nip at the deformed part. The width of a nip to be formed is from 1 to 10 mm, and preferably from 1.5 to 7 mm. The fixation linear velocity is set preferably between 40 mm/sec and 600 mm/sec.

(Recording Medium)

As a recording medium (also referred to as recording material, recording paper, paper for recording, etc.), those generally used may be used, and there is no particular restriction, insofar as it can keep a toner image formed by a publicly known image formation method by an Image formation device, etc. Examples of an applicable image carrier include plain paper from thin paper to board, fine quality paper, art paper, and coated printing paper such as coated paper, commercially-supplied Japanese paper, postcard paper, plastic film for OHP, cloth, aluminum deposited film, PET film, and synthesis paper.

(Image Formation Device)

The fourth aspect is an image formation device for fixing an image forming layer (A) to be formed using a white toner, and an image forming layer (B) to be formed adjacent to the image forming layer (A) using a toner different from the white toner on a recording medium. Expressing the volume median diameter of the white toner as Dw, the average circularity of the same as Sw, the volume median diameter of the toner different from the white toner as Dc, and the average circularity of the same as Sc, the image formation device is characterized in that it satisfies the following relational expressions (1) and (2):

$$1.000<Dw/Dc<1.300 \quad (1),$$

and $$1.000\leq Sc/Sw<1.060 \quad (2).$$

As described above, the present invention is characterized in that a white toner and an Other Toner, which satisfy the relational expressions (1) and (2), are used. Therefore, the toner can be provided to an image formation device, which structure per se is publicly known. With respect to an example of an image formation device to be provided with a white toner and an Other Toner, for example, Japanese Patent Application Publication No. 2002-328501 may be referred to.

Aspects of the present invention have been described above, provided the present invention be not limited to the above modes and various alterations are possible.

EXAMPLES

Advantageous effects of the present invention will be described by way of Examples and Comparative Examples. Naturally, the present invention is not limited to those embodiments. The term "part" or "%" which may appear in Examples means herein "part by weight" or "weight-%" unless otherwise specified.

Further, unless otherwise specified, each operation is carried out at room temperature (25° C.).

<Measurement and Calculation Method>

1. Toner Particles Size

Measurement and calculation are made using a Coulter Counter Multisizer 3 (produced by Beckman Coulter, Inc.) connected with a computer system (produced by Beckman Coulter, Inc.) loaded with a data processing software "Software V3.51".

As for a measurement protocol, 0.02 g of a toner is conditioned with 20 mL of a surfactant solution for facilitating dispersion of the toner (for example, a surfactant solution prepared by diluting 10-fold a neutral detergent containing a surfactant component with pure water [e.g. "CONTAMINON N" produced by Wako Pure Chemical Industries, Ltd. (a 10 weight-% aqueous solution of a pH 7-neutral detergent for cleaning a high precision measurement device, composed of a nonionic surfactant, an anionic surfactant, and an organic builder)]), and dispersed by an ultrasonic dispersion for 1 min to prepare a toner dispersion liquid. The toner dispersion liquid is injected using a pipette in a beaker on a sample stand containing ISOTON II (produced by Beckman Coulter, Inc.) to a concentration of 5% to 10% as displayed by the measurement apparatus. Within the concentration range, a measured value with good reproducibility can be obtained. Setting the measurement apparatus for a measurement particle count number at 25,000, and for an aperture diameter at 100 μm, frequency values are determined by dividing a measurement range of from 2.0 to 60 μm into 256 sections, and then a particle size at which a cumulative value of the volume fractions from a larger particle size side reaches 50% is defined as a volume median diameter (volume-based median diameter, volume D50).

As the particle size of a toner, the 3rd decimal place is rounded off, and the value calculated to the 2nd decimal place is adopted.

Further, Dw/Dc is calculated to the 3rd decimal place by rounding off the 4th decimal place of a value calculated from volume median diameters determined as above.

2. Average Circularity of Toner

As an average circularity of a toner, a value measured using a "FPIA-2100" (produced by Sysmex Corporation) is used.

Specifically, 0.1 g of a toner is conditioned with 50 mL of a surfactant solution (CONTAMINON N produced by Wako Pure Chemical Industries, Ltd. (a 10 weight-% aqueous solution of a pH 7-neutral detergent for cleaning a high precision measurement device, composed of a nonionic surfactant, an anionic surfactant, and an organic builder)), and dispersed by an ultrasonic dispersion for 1 min to prepare a toner dispersion liquid. The dispersion liquid is measured using the FPIA-2100 in HPF mode (high magnification imaging) at a proper concentration giving a detection number of 3,000 to 10,000. Within the range, the same value is obtained with good reproducibility. As a sheath liquid, a Particle Sheath "PSE-900A" (produced by Sysmex Corporation) was used.

The circularity as defined by the following formula is determined for each particle, which is then summed up, and the sum is divided by the total number of particles to give a computed average circularity.

Circularity=(perimeter of circle having the same area as projected particle image)/(perimeter of projected particle image)

In this regard, the average circularity of a toner adopts a measured value rounded to the 3rd decimal place.

Further, Sc/Sw is calculated to the 3rd decimal place by rounding of the 4th decimal place of a value calculated from values determined as above.

3. Endothermic Peak Temperature of Crystalline Polyester Resin and Glass Transition Temperature (Tg) of Amorphous Resin The endothermic peak temperature of a crystalline polyester resin and the glass transition temperature (Tg) of an amorphous resin are determined according to ASTM D3418 using a differential scanning calorimeter (DSC-60A, produced by Shimadzu Corporation). For temperature correction of a detection unit of the apparatus (DSC-60A), the melting points of indium and zinc were used, and for calorie correction, the heat of fusion of indium was used. For a sample, an aluminum pan was used. As a control a vacant pan was set, the temperature was raised at a temperature increase rate of 10° C./min, kept at 200° C. for 5 min, chilled from 200° C. to 0° C. at a rate of −10° C./min using liquid nitrogen, held at 0° C. for 5 min, and again heated up from 0° C. to 200° C. at a rate of 10° C./min. An analysis was carried out based on an endothermic curve at the 2nd temperature increase, wherein with respect to an amorphous resin an onset temperature was defined as Tg, and with respect to a crystalline polyester resin a maximum peak was defined as an endothermic peak temperature.

4. Volume Mean Diameter of Resin Particles, Colorant Particles, Mold Releasing Agent, Etc.

The volume mean diameters of resin particles, colorant particles, mold releasing agent, etc. were measured by a laser diffraction scattering particle size distribution analyzer (Microtrac particle size distribution analyzer "UPA-150", produced by Nikkiso Co., Ltd.).

Production Example 1-1

Production of White Toner a (Synthesis of Amorphous Resin [1])

Ninety parts by weight of terephthalic acid (TPA), 6 parts by weight of trimellitic acid (TMA), 19 parts by weight of fumaric acid (FA), 85 parts by weight of dodecenyl succinic anhydride (DDSA), 351 parts by weight of bisphenol A-propyleneoxide adduct (BPA-PO) and 58 parts by weight of bisphenol A-ethylene oxide adduct (BPA-EO) were charged in a reactor provided with a stirrer, a thermometer, a condenser, and a nitrogen gas feed tube, the inside of the reactor was purged with a dry nitrogen gas, to which 0.1 part by weight of titanium tetrabutoxide was added, and the content was subjected to a polymerization reaction with stirring in a flowing nitrogen gas at 180° C. for 8 hours. Further, 0.2 part by weight of titanium tetrabutoxide was added and the temperature was raised to 220° C., and a polymerization reaction was carried out for another 6 hours with stirring, and then, the pressure inside the reactor was reduced to 10 mmHg for a reaction under reduced pressure, to obtain an amorphous resin [1] in a transparent pale yellow color (amorphous polyester resin). The glass transition temperature (Tg) of the amorphous resin [1] was 59° C., the softening point was 101° C., and the weight-average molecular weight (Mw) was 17,000.

(Synthesis of Crystalline Polyester Resin [1])

Three hundred thirty parts by weight of 1,10-dodecanedioic acid, 230 parts by weight of 1,9-nonane diol were charged in a reactor provided with a stirrer, a thermometer, a condenser, and a nitrogen gas feed tube, the inside of the reactor was purged with a dry nitrogen gas, to which 0.1 part by weight of titanium tetrabutoxide was added, and the content was subjected to a polymerization reaction with stirring in a flowing nitrogen gas at 180° C. for 8 hours. Further, 0.2 part by weight of titanium tetrabutoxide was added and the temperature was raised to 220° C., and a polymerization reaction was carried out for another 6 hours with stirring, and then, the pressure inside the reactor was reduced to 10 mmHg for a reaction under reduced pressure, to obtain a crystalline polyester resin [1]. The melting point (Tm) of the crystalline polyester resin [1] was 72° C., and the weight-average molecular weight (Mw) was 15,000.

(Particle Size Regulation Step)

In a twin-screw extruder kneader, 285 parts by weight of the amorphous resin [1], 58 parts by weight of the crystalline polyester resin [1], 69 parts by weight of anatase-type titanium oxide (volume mean diameter 150 nm), and 70 parts by weight of a mold releasing agent (Fischer-Tropsch wax: FNP-0090) were kneaded at 120° C. After kneading the kneaded product was cooled to 25° C.

Next, the kneaded product was crushed coarsely by a hammer mill, ground coarsely by a TurboMill (produced by Turbo Kogyo Co., Ltd. (Freund-Turbo Corporation)) and then subjected to a fine powder classification treatment with a flow classifier utilizing a Coanda effect to yield a base material particle (a-1) in a white color with a volume median diameter of 7.20 μm, and a CV of 30.

(Circularity Regulation Step)

Into an aqueous dispersing medium prepared by dissolving 5 parts by weight of sodium polyoxyethylene lauryl ether sulfate in 500 parts by weight of ion exchanged water, the base material particle (a-1) was added and kept at 80° C. for 3.5 hours, and moved to a cooling step at a time point when the circularity became 0.932. After repeating filtration and washing, and finally after drying, a toner particle was obtained.

To the obtained toner particle, 1 weight-% of hydrophobic silica (number average primary particle size=12 nm, hydrophobicity=68), and 1 weight-% of hydrophobic titanium oxide (number average primary particle size=20 nm, hydrophobicity=63) were added, and mixed by a Henschel mixer (it is also called for 'FM mixer') (produced by Mitsui Miike Chemical Engineering Machinery, Co., Ltd. (NIPPON COKE & ENGINEERING, Co., Ltd.)), and the mixture was screened by a sieve with openings of 45 μm to remove coarse particles, thereby obtaining a white toner (a) with a volume median diameter of 7.16 μm, and an average circularity of 0.932.

Production Example 1-2

Production of White Toner b (Preparation of Dispersion Liquid of Amorphous Resin [1] Fine Particles)

After dissolving 200 parts by weight of the amorphous resin [1] produced in Production Example 1-1 in 200 parts by weight of ethyl acetate, the solution was mixed with an aqueous solution, in which sodium polyoxyethylene lauryl ether sulfate was dissolved to a concentration of 1 weight-% in 800 parts by weight of ion exchanged water, and dispersed using an ultrasonic homogenizer. From this dispersion liquid, ethyl acetate was removed under reduced pressure and the solid concentration was adjusted to 20 weight-%. As the result, a dispersion liquid of amorphous resin fine particles, in which fine particles of the amorphous resin [1] were dispersed in an aqueous medium, was prepared. The volume mean diameter (Mv) of fine particles of the amorphous resin [1] was 220 nm.

(Preparation of Dispersion Liquid of Crystalline Polyester Resin [1] Fine Particles)

After dissolving 200 parts by weight of the crystalline polyester resin [1] produced in Production Example 1-1 in 200 parts by weight of ethyl acetate heated to 70° C., the solution was mixed with an aqueous solution, in which sodium polyoxyethylene lauryl ether sulfate was dissolved to a concentration of 1 weight-% in 800 parts by weight of ion exchanged water, and dispersed using an ultrasonic homogenizer. From this dispersion liquid, ethyl acetate was removed under reduced pressure and the solid concentration was adjusted to 20 weight-%. As the result, a dispersion liquid of crystalline polyester resin [1] fine particles, in which fine particles of the crystalline polyester resin [1] were dispersed in an aqueous medium, was prepared. The volume mean diameter (Mv) of the crystalline polyester resin [1] fine particles was 220 nm.

(Preparation of Dispersion Liquid of Colorant Fine Particles (White))

After charging 210 parts by weight of rutile-type titanium oxide (produced by Ishihara Sangyo Kaisha, Ltd.) in a surfactant aqueous solution prepared by dissolving 1 weight-% of sodium alkyldiphenyl ether disulfonate in 480 parts by weight of ion exchanged water (with respect to 100 weight-% of the surfactant aqueous solution), dispersion was conducted using an ultrasonic homogenizer. The solid concentration was adjusted to 30 weight-%. The volume mean diameter (Mv) of the colorant fine particles was 200 nm.

(Preparation of Dispersion Liquid of Mold Releasing Agent Fine Particles)

Two hundred parts by weight of a Fischer-Tropsch wax "FNP-0090" (melting point 89° C., produced by Nippon Seiro Co., Ltd.) as a mold releasing agent was heated to 95° C. to melt, which was then charged in a surfactant aqueous solution prepared by dissolving sodium alkyldiphenyl ether disulfonate to a concentration of 3 weight-% in 800 parts by weight of ion exchanged water (with respect to the surfactant aqueous solution as 100 weight-%), followed by a dispersion treatment using an ultrasonic homogenizer. The solid concentration was adjusted to 20 weight-%. By this a dispersion liquid of mold releasing agent fine particles [1], in which mold releasing agent fine particles were dispersed in an aqueous medium, was prepared.

The volume mean diameter (Mv) of mold releasing agent fine particles in the dispersion liquid of mold releasing agent fine particles [1] was measured using a Microtrac particle size distribution analyzer "UPA-150" (produced by Nikkiso Co., Ltd.) to find 180 nm.

(Coagulating and Fusing Step)

After charging 395 parts by weight of the dispersion liquid of amorphous resin [1] fine particles, 80 parts by weight of the dispersion liquid of crystalline polyester resin [1] fine particles, 97 parts by weight of the dispersion liquid of mold releasing agent fine particles, 229 parts by weight of the dispersion liquid of colorant fine particles, and 0.5 part by weight of the aqueous solution of sodium polyoxyethylene lauryl ether sulfate into a reactor provided with a stirrer, a condenser, and a thermometer, 0.1 N hydrochloric acid was added with stirring to adjust the pH to 2.5. Then 0.4 part by weight of an aqueous solution of poly aluminum chloride (10 weight-% aqueous solution in terms of $AlCl_3$) was dropped over 10 min, then the temperature was raised with stirring from 25° C. at a rate of 0.05° C./min, and the particle size of an agglomerated particle was measured appropriately by a "Multisizer 3" (produced by Beckman Coulter, Inc.). The temperature increase was terminated at 75° C., where the volume median diameter of agglomerated particles reached 6.20 μm, and 222.2 parts by weight of the dispersion liquid of amorphous resin [1] fine particles was dropped over 1 hour, while maintaining the temperature at 75° C. After completion of dropping, particle size growth was terminated by making the pH of the system to 8.5 with a 0.5 N sodium hydroxide aqueous solution (volume median diameter 6.25 μm).

(Circularity Regulation Step)

The internal temperature of the solution obtained above was raised to 85° C., and when the average circularity according to "FPIA-2000" (produced by Sysmex Corporation) reached 0.942 (retention time at 85° C. was 200 min), the temperature of the solution was lowered to room temperature at a rate of 10° C./min.

(Filtration, Washing, and Drying Step)

After repeating filtration and washing of the reaction solution, drying was conducted to obtain toner particles.

(External Additive Addition Step)

To the obtained toner particles, 1 weight-% of hydrophobic silica (number average primary particle size=12 nm, hydrophobicity=68), and 1 weight-% of hydrophobic titanium oxide (number average primary particle size=20 nm, hydrophobicity=63) were added and mixed by a Henschel mixer (produced by Mitsui Miike Chemical Engineering Machinery, Co., Ltd.), and the mixture was screened by a sieve with openings of 45 μm to remove coarse particles, thereby obtaining a white toner b. The volume median diameter of the white toner b was 6.05 μm, and the average circularity was 0.942.

Production Example 1-3

Production of White Toner c

In the coagulating and fusing step of Production Example 1-2, the temperature increase was terminated at 75° C., where the volume median diameter of agglomerated particles reached 6.30 μm, and 222.2 parts by weight of the dispersion liquid of amorphous resin [1] fine particles was dropped over 1 hour, while maintaining the temperature at 75° C. After completion of dropping, particle size growth was terminated when the volume median diameter was 6.90 μm by making the pH of the system to 8.5 with a 0.5 N sodium hydroxide aqueous solution, and when the average circularity reached 0.922 in the circularity regulation step (retention time at 85° C. was 60 min), the cooling step was started. Except the above, a white toner c was produced identically with Production Example 1-2. The volume median diameter of the white toner c was 6.73 μm, and the average circularity was 0.922.

Production Example 1-4

Production of White Toner d

A white toner d was produced by the same production method as Production Example 1-1 except that in the particle size regulation step of Production Example 1-1 a grinding condition (rotation time) of the TurboMill was changed to make the volume median diameter in the particle size regulation step to 7.24 μm, and in the circularity regulation step the retention time at 80° C. was changed to 3.5 hours to make the circularity to 0.923. The volume median diameter of the white toner d was 7.16 μm, and the average circularity was 0.923.

Production Example 1-5

Production of White Toner e

A white toner e was produced by the same production method as Production Example 1-1 except that in the particle size regulation step of Production Example 1-1 a grinding condition (rotation time) of the TurboMill was changed to make the volume median diameter in the particle size regulation step to 7.32 μm, and in the circularity regulation step the retention time at 80° C. was changed to 2 hours to make the circularity to 0.911. The volume median diameter of the white toner e was 7.19 μm, and the average circularity was 0.912.

Production Example 1-6

Production of White Toner f

A white toner f was produced by the same production method as Production Example 1-1 except that in the particle size regulation step of Production Example 1-1, the crystalline polyester resin [1] was not added, and also in the particle size regulation step a grinding condition (rotation time) of the TurboMill was changed to make the volume median diameter to 7.35 μm, and in the circularity regulation step the retention time at 80° C. was changed to 3 hours to make the circularity to 0.922. The volume median diameter of the white toner f was 7.18 μm, and the average circularity was 0.921.

Production Example 1-7

Production of White Toner g

A white toner g was produced by the same production method as Production Example 1-1 except that Production Example 1-1 a grinding condition (rotation time) of the TurboMill was changed to make the volume median diameter in the particle size regulation step to 7.75 μm, and in the circularity regulation step the retention time at 80° C. was changed to 1.5 hours to make the circularity to 0.905. The volume median diameter of the white toner g was 7.68 μm, and the average circularity was 0.906.

Production Example 1-8

Production of White Toner h

A white toner h was produced by the same production method as Production Example 1-1 except that in Production Example 1-1 a grinding condition (rotation time) of the TurboMill was changed to make the volume median diameter in the particle size regulation step to 6.87 μm, and the circularity regulation step was not performed. The volume median diameter of the white toner h was 6.87 μm, and the average circularity was 0.897.

Production Example 1-9

Production of White Toner i

A white toner i was produced by the same production method as Production Example 1-1 except that in the particle size regulation step of Production Example 1-1 a grinding condition (rotation time) of the TurboMill was changed to make the volume median diameter in the particle size regulation step to 6.95 μm, and in the circularity regulation step the retention time at 80° C. was changed to 2 hours to make the circularity to 0.911. The volume median diameter of the white toner i was 6.86 μm, and the average circularity was 0.911.

Production Example 2-1

Production of Color Toner 1 (Yellow)

(Preparation of Dispersion Liquid of Colorant Fine Particles)

After charging 50 parts by weight of monoazo yellow pigment (C. I. Pigment yellow 74) as a colorant in a surfactant aqueous solution prepared by dissolving sodium alkyldiphenyl ether disulfonate in 200 parts by weight of ion exchanged water to a concentration of 1 weight-% (with respect to the surfactant aqueous solution as 100 weight-%), a dispersion treatment was conducted using an ultrasonic homogenizer. The solid concentration was adjusted to 20 weight-%. By this, a dispersion liquid of yellow colorant fine particles [1], in which colorant fine particles were dispersed in an aqueous medium, was prepared.

The volume mean diameter (Mv) of colorant fine particles in the dispersion liquid of yellow colorant fine particles [1] was 170 nm.

A color toner 1 was produced the same as in Production Example 1-2 except that in the coagulating and fusing step of Production Example 1-2, 390 parts by weight of the dispersion liquid of amorphous resin [1] fine particles, 84 parts by weight of the dispersion liquid of crystalline polyester resin [1] fine particles, 90 parts by weight of the dispersion liquid of mold releasing agent fine particles, 153 parts by weight of the dispersion liquid of yellow colorant fine particles [1], and 0.5 part by weight of the sodium polyoxyethylene lauryl ether sulfate aqueous solution were used, the temperature increase was terminated at 75° C., where the volume median diameter of an agglomerated particle reached 5.90 μm, then 222.2 parts by weight of the dispersion liquid of amorphous resin fine particles [1] was dropped over 1 hour while maintaining the temperature at 75° C., then after completion of dropping particle size growth was terminated by making the pH of the system to 8.5 with a 0.5 N sodium hydroxide aqueous solution when the volume median diameter was 6.00 μm, and when the average circularity reached 0.955 in the circularity regulation step (retention time at 85° C. was 200 min) the cooling step was started. The volume median diameter of the color toner 1 was 5.82 μm, and the average circularity was 0.954.

Production Example 2-2

Production of Color Toner 2 (Magenta)

After charging 50 parts by weight of quinacridone magenta pigment (Pigment red 122) as a colorant in a surfactant aqueous solution prepared by dissolving sodium alkyldiphenyl ether disulfonate in 200 parts by weight of ion exchanged water to a concentration of 1 weight-% (with respect to the surfactant aqueous solution as 100 weight-%), a dispersion treatment was conducted using an ultrasonic homogenizer. The solid concentration was adjusted to 20 weight-%. By this, a dispersion liquid of magenta colorant fine particles [2], in which colorant fine particles were dispersed in an aqueous medium, was prepared.

The volume mean diameter (Mv) of colorant fine particles in the dispersion liquid of magenta colorant fine particles [2] was 150 nm.

A color toner 2 was produced the same as in Production Example 1-2 except that in the coagulating and fusing step of Production Example 1-2, 390 parts by weight of the dispersion liquid of amorphous resin [1] fine particles, 84 parts by weight of the dispersion liquid of crystalline polyester resin [1] fine particles, 90 parts by weight of the dispersion liquid of mold releasing agent fine particles, 149 parts by weight of the dispersion liquid of magenta colorant fine particles [2], and 0.5 part by weight of the sodium polyoxyethylene lauryl ether sulfate aqueous solution were used, the temperature increase was terminated at 75° C., where the volume median diameter of an agglomerated particle reached 5.90 μm, then 222.2 parts by weight of the dispersion liquid of amorphous resin fine particles [1] was dropped over 1 hour while maintaining the temperature at 75° C., then after completion of dropping, particle size growth was terminated by making the pH of the system to 8.5 with a 0.5 N sodium hydroxide aqueous solution when the volume median diameter was 6.00 μm, and when the average circularity reached 0.955 in the circularity regulation step (retention time at 85° C. was 180 min) the cooling step was started. The volume median diameter of the color toner 2 was 5.79 μm, and the average circularity was 0.952.

Production Example 2-3

Production of Color Toner 3 (Cyan)

After charging 50 parts by weight of copper phthalocyanine (C. I. Pigment Blue 15: 3) as a colorant in a surfactant aqueous solution prepared by dissolving sodium alkyldiphenyl ether disulfonate in 200 parts by weight of ion exchanged water to a concentration of 1 weight-% (with respect to the surfactant aqueous solution as 100 weight-%), a dispersion treatment was conducted using an ultrasonic homogenizer. The solid concentration was adjusted to 20 weight-%. By this, a dispersion liquid of cyan colorant fine particles [3], in which colorant fine particles were dispersed in an aqueous medium, was prepared.

The volume mean diameter (Mv) of colorant fine particles in the dispersion liquid of cyan colorant fine particles [3] was 150 nm.

A color toner 3 was produced the same as in Production Example 1-2 except that in the coagulating and fusing step of Production Example 1-2, 390 parts by weight of the dispersion liquid of amorphous resin [1] fine particles, 84 parts by weight of the dispersion liquid of crystalline polyester resin [1] fine particles, 90 parts by weight of the dispersion liquid of mold releasing agent fine particles, 139 parts by weight of the dispersion liquid of cyan colorant fine particles [3], and 0.5 part by weight of the sodium polyoxyethylene lauryl ether sulfate aqueous solution were used, the temperature increase was terminated at 75° C., where the volume median diameter of an agglomerated particle reached 5.80 μm, then 222.2 parts by weight of the dispersion liquid of amorphous resin fine particles [1] was dropped over 1 hour while maintaining the temperature at 75° C., then after completion of dropping, particle size growth was terminated by making the pH of the system to 8.5 with a 0.5 N sodium hydroxide aqueous solution when the volume median diameter was 5.90 μm, and when the average circularity reached 0.955 in the circularity regulation step (retention time at 85° C. was 240 min) the cooling step was started. The volume median diameter of the color toner 3 was 5.60 μm, and the average circularity was 0.955.

Production Example 2-4

Production of Color Toner 4 (Black)

After charging 50 parts by weight of carbon black (Regal 330R: produced by Cabot Corporation) as a colorant in a surfactant aqueous solution prepared by dissolving sodium alkyldiphenyl ether disulfonate in 200 parts by weight of ion exchanged water to a concentration of 1 weight-% (with respect to the surfactant aqueous solution as 100 weight-%), a dispersion treatment was conducted using an ultrasonic homogenizer. The solid concentration was adjusted to 20 weight-%. By this, a dispersion liquid of black colorant fine particles [4], in which colorant fine particles were dispersed in an aqueous medium, was prepared.

The volume mean diameter (Mv) of colorant fine particles in the dispersion liquid of black colorant fine particles [4] was 180 nm.

A color toner 4 was produced the same as in Production Example 1-2 except that in the coagulating and fusing step of Production Example 1-2, 390 parts by weight of the dispersion liquid of amorphous resin [1] fine particles, 84 parts by weight of the dispersion liquid of crystalline polyester resin [1] fine particles, 90 parts by weight of the dispersion liquid of mold releasing agent fine particles, 158 parts by weight of the dispersion liquid of black colorant fine particles [4], and 0.5 part by weight of the sodium polyoxyethylene lauryl ether sulfate aqueous solution were used, the temperature increase was terminated at 75° C., where the volume median diameter of an agglomerated particle reached 5.80 μm, then 222.2 parts by weight of the dispersion liquid of amorphous resin fine particles [1] was dropped over 1 hour while maintaining the temperature at 75° C., then after completion of dropping, particle size growth was finished by making the pH of the system to 8.5 with a 0.5 N sodium hydroxide aqueous solution when the volume median diameter was 5.90 μm, and when the average circularity reached 0.955 in the circularity regulation step (retention time at 85° C. was 220 min) the cooling step was started. The volume median diameter of the color toner 4 was 5.74 μm, and the average circularity was 0.957.

Production Example 2-5

Production of Color Toner 5 (Yellow)

(Particle Size Regulation Step)

In a twin-screw extruder kneader, 285 parts by weight of the amorphous resin [1] obtained in Production Example 1-1, 61 parts by weight of the crystalline polyester resin [1], 31 parts by weight of a yellow pigment (C. I. Pigment yellow 74), and 66 parts by weight of a mold releasing agent (Fischer-Tropschwax: FNP-0090) were kneaded at 110° C. After kneading the kneaded product was cooled to 25° C.

Next, the kneaded product was crushed coarsely by a hammer mill, ground coarsely by a TurboMill (produced by Turbo Kogyo Co., Ltd.), and then subjected to a fine powder classification treatment with a flow classifier utilizing a Coanda effect to yield a base material particle (5-1) of a yellow toner with a volume median diameter of 7.20 μm, and a CV of 30.

(Circularity Regulation Step)

Into an aqueous dispersing medium prepared by dissolving 5 parts by weight of sodium polyoxyethylene lauryl ether sulfate in 500 parts by weight of ion exchanged water, the base material particle (5-1) was added and kept at 80° C. for 3.5 hours, and moved to a cooling step. The reaction liquid was repeatedly filtrated and washed, and then dried to yield toner particles. To the obtained toner particles, 1 weight-% of hydrophobic silica (number average primary particle size=12 nm, hydrophobicity=68), and 1 weight-% of hydrophobic titanium oxide (number average primary particle size=20 nm, hydrophobicity=63) were added and mixed by a Henschel mixer (produced by Mitsui Miike Chemical Engineering Machinery, Co., Ltd.), and the mixture was screened by a sieve with openings of 45 μm to remove coarse particles, thereby obtaining a color toner 5. The volume median diameter of the color toner 5 was 7.04 μm, and the average circularity was 0.925.

Production Example 2-6

Production of Color Toner 6 (Magenta)

A color toner 6 was produced by the same production method as Production Example 2-5 except that in Production Example 2-5, 31 parts by weight of the yellow pigment was changed to 30 parts by weight of a magenta pigment (Pigment red 122), in the particle size regulation step a grinding condition (rotation time) of the TurboMill was changed to make the volume median diameter in the particle size regulation step to 7.15 μm, and in the circularity regulation step the retention time at 80° C. was changed to 3.5 hours to make the circularity to 0.925. The volume median diameter of the color toner 6 was 7.01 μm, and the average circularity was 0.924.

Production Example 2-7

Production of Color Toner 7 (Cyan)

A color toner 7 was produced by the same production method as Production Example 2-5 except that in Production Example 2-5, 31 parts by weight of the yellow pigment was changed to 28 parts by weight of a cyan pigment (C. I. Pigment Blue 15: 3), in the particle size regulation step a grinding condition (rotation time) of the TurboMill was changed to make the volume median diameter in the particle size regulation step to 7.20 μm, and in the circularity regulation step the retention time at 80° C. was changed to 4.0 hours to make the circularity to 0.930. The volume median diameter of the color toner 7 was 7.09 μm, and the average circularity was 0.931.

Production Example 2-8

Production of Color Toner 8 (Black)

A color toner 8 was produced by the same production method as Production Example 2-5 except that in Production Example 2-5, 31 parts by weight of the yellow pigment was changed to 32 parts by weight of a black pigment (carbon black "Regal 330R"), in the particle size regulation step a grinding condition (rotation time) of the TurboMill was changed to make the volume median diameter in the particle size regulation step to 7.15 μm, and in the circularity regulation step the retention time at 80° C. was changed to 4.0 hours to make the circularity to 0.930. The volume median diameter of the color toner 8 was 7.06 μm, and the average circularity was 0.929.

Examples 1 to 7, and Comparative Examples 1 to 4

The white toners and color toners (yellow, magenta, cyan, and black) were combined as described in the following Table 1 and Table 2.

(Preparation of Developer)

A developer was produced by admixing a ferrite carrier, which is coated with a silicone resin, and has a volume mean diameter of 60 μm, to each toner such that the toner concentration becomes 6 weight-%.

TABLE 1

| | Toner No. | | White | Yellow | | Magenta | | Cyan | | Black | |
|---|---|---|---|---|---|---|---|---|---|---|---|
| | YMCK | W | Dw (μm) | Dc (μm) | Dw/Dc | Dc (μm) | Dw/Dc | Dc (μm) | Dw/Dc | Dc (μm) | Dw/Dc |
| Example 1 | 1234 | a | 7.16 | 5.82 | 1.230 | 5.79 | 1.237 | 5.60 | 1.279 | 5.74 | 1.247 |
| Example 2 | 1234 | b | 6.05 | 5.82 | 1.040 | 5.79 | 1.045 | 5.60 | 1.080 | 5.74 | 1.054 |
| Example 3 | 1234 | c | 6.73 | 5.82 | 1.156 | 5.79 | 1.162 | 5.60 | 1.202 | 5.74 | 1.172 |
| Example 4 | 5678 | d | 7.16 | 7.04 | 1.017 | 7.01 | 1.021 | 7.09 | 1.010 | 7.06 | 1.014 |
| Example 5 | 5678 | e | 7.19 | 7.04 | 1.021 | 7.01 | 1.026 | 7.09 | 1.014 | 7.06 | 1.018 |
| Example 6 | 5678 | f | 7.18 | 7.04 | 1.020 | 7.01 | 1.024 | 7.09 | 1.013 | 7.06 | 1.017 |
| Example 7 | 1234 | i | 6.86 | 5.82 | 1.179 | 5.79 | 1.185 | 5.60 | 1.225 | 5.74 | 1.195 |
| Comparative Example 1 | 5678 | c | 6.73 | 7.04 | 0.956 | 7.01 | 0.960 | 7.09 | 0.949 | 7.06 | 0.953 |
| Comparative Example 2 | 1234 | g | 7.68 | 5.82 | 1.320 | 5.79 | 1.326 | 5.60 | 1.371 | 5.74 | 1.338 |
| Comparative Example 3 | 1234 | h | 6.87 | 5.82 | 1.180 | 5.79 | 1.187 | 5.60 | 1.227 | 5.74 | 1.197 |
| Comparative Example 4 | 5678 | a | 7.16 | 7.04 | 1.017 | 7.01 | 1.021 | 7.09 | 1.010 | 7.06 | 1.014 |

TABLE 2

| | Toner No. | | White | Yellow | | Magenta | | Cyan | | Black | |
|---|---|---|---|---|---|---|---|---|---|---|---|
| | YMCK | W | Sw | Sc | Sc/Sw | Sc | Sc/Sw | Sc | Sc/Sw | Sc | Sc/Sw |
| Example 1 | 1234 | a | 0.932 | 0.954 | 1.024 | 0.952 | 1.021 | 0.955 | 1.025 | 0.957 | 1.027 |
| Example 2 | 1234 | b | 0.942 | 0.954 | 1.013 | 0.952 | 1.011 | 0.955 | 1.014 | 0.957 | 1.016 |
| Example 3 | 1234 | c | 0.922 | 0.954 | 1.035 | 0.952 | 1.033 | 0.955 | 1.036 | 0.957 | 1.038 |
| Example 4 | 5678 | d | 0.923 | 0.925 | 1.002 | 0.924 | 1.001 | 0.931 | 1.009 | 0.929 | 1.007 |
| Example 5 | 5678 | e | 0.912 | 0.925 | 1.014 | 0.924 | 1.013 | 0.931 | 1.021 | 0.929 | 1.019 |
| Example 6 | 5678 | f | 0.921 | 0.925 | 1.004 | 0.924 | 1.003 | 0.931 | 1.011 | 0.929 | 1.009 |
| Example 7 | 1234 | i | 0.911 | 0.954 | 1.047 | 0.952 | 1.045 | 0.955 | 1.048 | 0.957 | 1.050 |
| Comparative Example 1 | 5678 | c | 0.922 | 0.925 | 1.003 | 0.924 | 1.002 | 0.931 | 1.010 | 0.929 | 1.008 |
| Comparative Example 2 | 1234 | g | 0.906 | 0.954 | 1.053 | 0.952 | 1.051 | 0.955 | 1.054 | 0.957 | 1.056 |
| Comparative Example 3 | 1234 | h | 0.897 | 0.954 | 1.064 | 0.952 | 1.061 | 0.955 | 1.065 | 0.957 | 1.067 |
| Comparative Example 4 | 5678 | a | 0.932 | 0.925 | 0.992 | 0.924 | 0.991 | 0.931 | 0.999 | 0.929 | 0.997 |

Evaluation Method

1. Fixability

Using a commercially-supplied all-in-one printer type full color copying machine "bizhub PRO C6500" (produced by Konica Minolta, Inc.) with a fixing unit modified such that the surface temperature of a heating roller for fixation was variable in a range from 100 to 210° C., developers were outputted on a 80 g/m$^2$-basis weight plain paper sheet as a 2×2 cm solid patch image with a coating weight of 3.0 g/m$^2$ for each of Y, M, and C, and fixed collectively at 180° C. Then the paper sheet was creased through the center of the solid patch image, a 3 kg-weight with a bottom diameter of 10 cm was moved back and forth 5 times thereon, and thereafter the paper sheet was unfolded, the image of which was then blown by 0.35 MPa-compressed air and used as a standard sample.

Next, as an evaluation sample, W at a coating weight of 3.4 g/m$^2$, and each of Y, M, and C at 3.0 g/m$^2$ were outputted in the order from the paper side of W, C, M, and Y, and fixed collectively, while raising the temperature of an upper belt from 170° C. by 5° C. up to a temperature at which detachment status of an evaluation sample and the standard sample became equal by visual comparison. In case where the detachment status became equal at a fixation temperature of 170° C. or 175° C., it was rated as A (excellent); in case where the detachment status became equal at a fixation temperature of 180° C. or 185° C., it was rated as B; in case where the detachment status became equal at a fixation temperature of 190° C., it was rated as C; and in case where the detachment status became equal at a fixation temperature of 195° C., it was rated as D (poor). If the rating is C or higher, the sample is on a practically acceptable level.

The results are shown in Table 3. Similarly, a case in which Y, M, and K were put on W, was also evaluated, as the results, the fixability was on the same level as in the following Table 3 except Example 1. In Example 1, in a case, in which Y, M, and K were put on W, fixation occurred at 175° C.

2. Color Development Property

Modifying a commercially-supplied all-in-one printer "bizhub Pro C500" (produced by Konica Minolta Business Solutions Japan Co., Ltd.) such that a white toner image forming unit is mounted at the position for Black, each developer according to a combination of toners listed in Table 1 was charged in a developing unit of a developing means, and the following evaluation was carried out.

A white toner image was formed on CF Paper (produced by Konica Minolta Inc.) in an environment of temperature 20° C., and humidity 50% RH; on the obtained white toner image yellow, cyan, magenta images were put on one by one to form a solid image (2 cm×2 cm); and the image saturation of the same was measured. The saturation values of a case, in which the developer combination set forth for Comparative Example 1 was used, were respectively regarded as 100, and relative increase or decrease of the saturation was computed.

Similarly, a black image was put on a white toner image to form a solid image (2 cm×2 cm) in an environment of temperature 20° C., and humidity 50% RH, and the image density of the same was measured. The density value of a case, in which the developer combination set forth for Comparative Example 1 was used, was regarded as 100, and relative increase or decrease of the density was computed. In a case in which the average value of saturation and density of 4 colors was equal or decreased, it was rated D (poor). In a case in which the average increased by less than 3%, it was rated C. In a case in which the average increased by 3% or more and less than 4%, it was rated B. In a case in which the average increased by 4% or more, it was rated A (excellent).

The saturation and density of an image are measured by a spectrophotometer "GretagMacbeth Spectrolino" (produced by GretagMacbeth GmbH (X-Rite GmbH)), using as a light source a D65 illuminant, a Φ4 mm-reflection measurement aperture, a measurement wavelength range of from 380 to 730 nm with a scanning interval of 10 nm, a viewing angle of 2°, and a dedicated white tile for calibration.

The results are shown in Table 3. In this regard, in Table 3, Average value=SUM (saturation and density of each image of Y, M, C and K %−100%)/4.

TABLE 3

| | Fixability | | Image saturation, density [%] | | | | | |
|---|---|---|---|---|---|---|---|---|
| | Fixation temperature (° C.) | Rating | Y | M | C | K | Average value (%) | Rating |
| Example 1 | 180 | B | 105.2 | 103.7 | 104.1 | 104.5 | 4.38 | A |
| Example 2 | 170 | A | 103.9 | 104.3 | 103.6 | 103.1 | 3.72 | B |
| Example 3 | 170 | A | 105.9 | 104.2 | 104.3 | 105.5 | 4.98 | A |
| Example 4 | 180 | B | 103.6 | 103.1 | 103.5 | 104.2 | 3.60 | B |
| Example 5 | 180 | B | 104.4 | 104 | 103.8 | 103.2 | 3.85 | B |
| Example 6 | 190 | C | 103.6 | 103.3 | 103.4 | 104 | 3.57 | B |
| Example 7 | 180 | B | 104.5 | 103.5 | 103.6 | 104.1 | 3.93 | B |
| Comparative Example 1 | 190 | C | 100 | 100 | 100 | 100 | — | — |
| Comparative Example 2 | 195 | D | 102.5 | 100.3 | 101.5 | 102.7 | 1.75 | C |
| Comparative Example 3 | 190 | C | 100.3 | 96.8 | 98.6 | 99.3 | −1.25 | D |
| Comparative Example 4 | 195 | D | 100.1 | 98.2 | 98.2 | 100.3 | −0.80 | D |

From the above results, images formed with white toners and color toners according to Examples 1 to 7 were superior in low temperature fixability. Further, images formed with white toners and color toners according to Examples 1 to 7 exhibited obviously high image saturation or density, and therefore, it was indicated that in the Examples 1 to 7 the masking performance of a white toner on a recording medium was high. On the other hand with respect to an image formed by the white toner and color toners of Comparative Example 1 with Dw/Dc of 1.000 or less, the image saturation or density was remarkably decreased. Meanwhile, with respect to an image formed by the white toner and color toners of Comparative Example 2 with Dw/Dc of 1.300 or higher, the low temperature fixability was remarkably decreased. With respect to an image formed by the white toner and color toners of Comparative Example 3 with Sc/Sw of 1.060 or higher, the image saturation or density was remarkably decreased. With respect to an image formed by the white toner and color toners of Comparative Example 4 with Sc/Sw of less than 1.000, the low temperature fixability and the image saturation or density were remarkably decreased. Therefore, it was indicated that in the Comparative Examples the masking performance of a white toner on a recording medium was low.

What is claimed is:

1. An image formation method for fixing an image forming layer (A) to be formed using a white toner, and an image forming layer (B) to be formed adjacent to the image forming layer (A) using a toner different from the white toner on a recording medium;

wherein, expressing the volume median diameter of the white toner as Dw, the average circularity of the same as Sw, the volume median diameter of the toner different from the white toner as Dc, and the average circularity of the same as Sc, the following relational expressions (1) and (2) are satisfied:

$$1.000<Dw/Dc<1.300 \quad (1)$$

$$1.000\leq Sc/Sw<1.060 \quad (2).$$

2. The image formation method according to claim 1, wherein the image forming layer (A) and the image forming layer (B) are fixed collectively to form an image.

3. The image formation method according to claim 1, wherein the toner different from the white toner is a color toner.

4. The image formation method according to claim 1, satisfying:

$$1.010<Sc/Sw<1.040.$$

5. The image formation method according to claim 1, satisfying:

$$0.910<Sw<0.943.$$

6. The image formation method according to claim 1, wherein the white toner and the toner different from the white toner comprise a crystalline polyester resin.

7. The image formation method according to claim 1, satisfying:

$$1.050<Dw/Dc<1.250.$$

8. A toner set comprising a white toner and a toner different from the white toner to be used for an image forming layer (B) adjacent to an image forming layer (A) to be formed using the white toner;

wherein, expressing the volume median diameter of the white toner as Dw, the average circularity of the same as Sw, the volume median diameter of the toner different from the white toner as Dc, and the average circularity of the same as Sc, the following relational expressions (1) and (2) are satisfied:

$$1.000<Dw/Dc<1.300 \quad (1)$$

$$1.000\leq Sc/Sw<1.060 \quad (2).$$

9. A white toner satisfying the following relational expressions (1) and (2) with respect to a relationship with a toner different from the white toner to be used for an image forming layer (B) adjacent to an image forming layer (A) to be formed using the white toner:

$$1.000<Dw/Dc<1.300 \quad (1)$$

$$1.000\leq Sc/Sw<1.060 \quad (2)$$

wherein, Dw stands for the volume median diameter of the white toner, Sw for the average circularity of the same, Dc for the volume median diameter of the toner different from the white toner, and Sc for the average circularity of the same.

* * * * *